US012330083B2

(12) United States Patent
Silverglate

(10) Patent No.: US 12,330,083 B2
(45) Date of Patent: Jun. 17, 2025

(54) INTERFERENCE JOINT DIGITS, BUILDING ELEMENTS, BUILDING SYSTEMS, AND ASSEMBLIES

(71) Applicant: Spin-Balls, LLC, Dania Beach, FL (US)

(72) Inventor: David Silverglate, Santa Cruz, CA (US)

(73) Assignee: Spin-Balls, LLC, Dania Beach, FL (US)

( * ) Notice: Subject to any disclaimer, the term of this patent is extended or adjusted under 35 U.S.C. 154(b) by 0 days.

(21) Appl. No.: 18/737,167

(22) Filed: Jun. 7, 2024

(65) Prior Publication Data

US 2024/0342623 A1 Oct. 17, 2024

Related U.S. Application Data

(63) Continuation of application No. PCT/US2023/068786, filed on Jun. 21, 2023.

(60) Provisional application No. 63/354,187, filed on Jun. 21, 2022.

(51) Int. Cl.
*A63H 33/04* (2006.01)
*A63H 33/06* (2006.01)

(52) U.S. Cl.
CPC ..... *A63H 33/042* (2013.01); *A63H 33/062* (2013.01)

(58) Field of Classification Search
CPC ..... A63H 33/06; A63H 33/08; A63H 33/084; A63H 33/086; A63H 33/062; A63H 33/105
USPC .... 472/85, 102, 103, 116, 119–123; 446/85, 446/102, 103, 116, 119–123
See application file for complete search history.

(56) References Cited

U.S. PATENT DOCUMENTS 3,755,959 A * 9/1973 Boberg ..... A63H 33/042 446/124
3,766,932 A 10/1973 Sidis et al.
5,049,104 A * 9/1991 Olsen ..... A63H 33/042 446/104
5,951,356 A 9/1999 Cyrus et al.
6,219,974 B1 4/2001 Hoberman
(Continued)

FOREIGN PATENT DOCUMENTS

AT 15608 U1 3/2018
WO 2022130285 A1 6/2022

OTHER PUBLICATIONS

International Search Report mailed on Oct. 5, 2023, issued in the corresponding International App. No. PCT/US23/68786, filed on Jun. 21, 2023; 2 pages.

(Continued)

*Primary Examiner* — Kien T Nguyen
(74) *Attorney, Agent, or Firm* — IPkey PLLC

(57) ABSTRACT

Toys, building sets, and toy assemblies are provided which include at least one digit or digit toy. Each digit toy includes a first segment and a second segment connected by a joint comprising a living hinge. Interference members of the joint interfere as the joint transitions between a first state (e.g., an extension state) and a second state (e.g., a flexion state). The first segment and the second segment each optionally include a first retention feature disposed on a same first side thereof, wherein the first retention features reversibly stabilize the first segment to the second segment in the second state.

25 Claims, 43 Drawing Sheets

(56) References Cited

U.S. PATENT DOCUMENTS

| | | | | |
|---|---|---|---|---|
| 6,508,689 | B1 | 1/2003 | Mikkelsen et al. | |
| 6,834,465 | B2 | 12/2004 | Hoberman | |
| 7,464,503 | B2 | 12/2008 | Hoberman | |
| 9,004,799 | B1 * | 4/2015 | Tibbits ..... | G09B 25/02 403/56 |
| 2002/0083675 | A1 | 7/2002 | Hoberman | |
| 2005/0016109 | A1 | 1/2005 | Rouse | |
| 2006/0014468 | A1 | 1/2006 | Zawitz | |
| 2020/0330894 | A1 | 10/2020 | Ashton | |

OTHER PUBLICATIONS

Written Opinion of the International Searching Authority mailed on Oct. 5, 2023, issued in the corresponding International App. No. PCT/US23/68786, filed on Jun. 21, 2023; 6 pages.

Ooi, Tian, "How to 3D Print Joints—Simply Explained," All3DP, Jan. 6, 2020, pp. 1-10 <https://all3dp.com/2/3d-printed-joints-the-basics/>.

Hinge—Incredibly Interconnectable Toys; accessed online Jan. 16, 2023, pp. 1-6 <https://connectabletoys.com/en/hinge>.

* cited by examiner

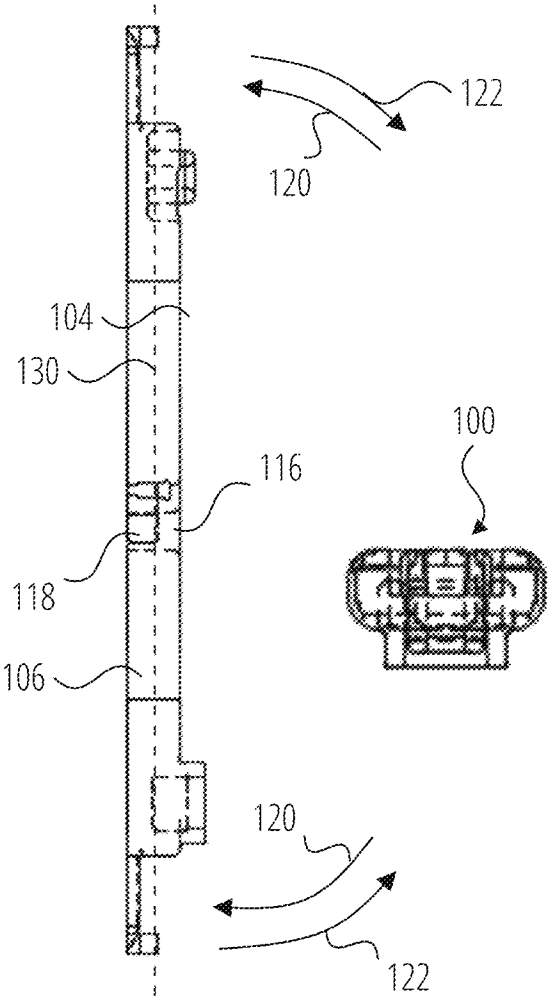
FIG. 1E
FIG. 1F
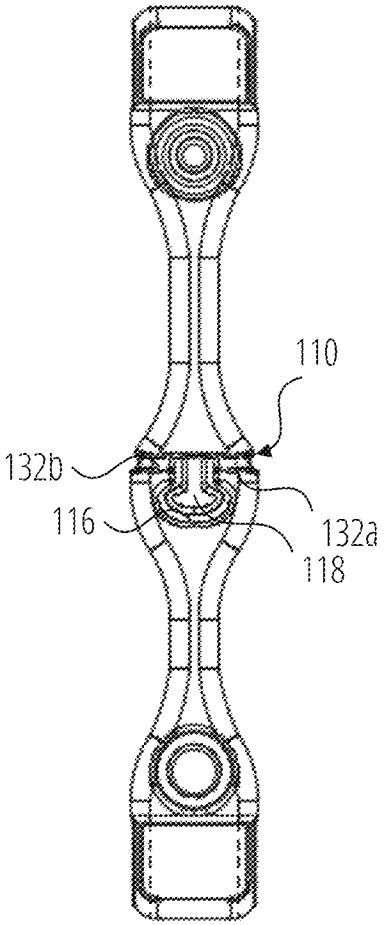
FIG. 1D
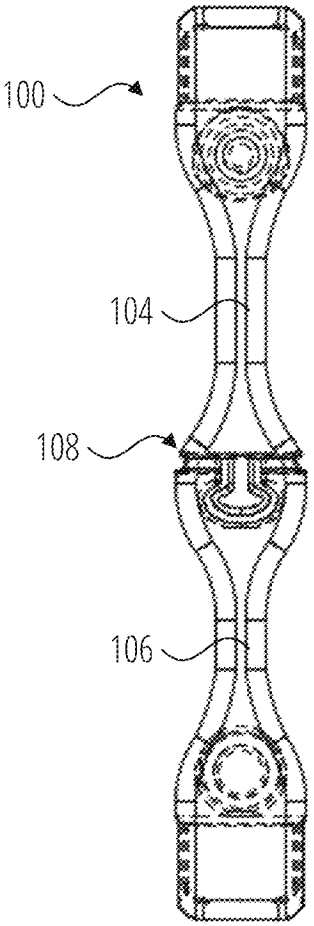
FIG. 1C

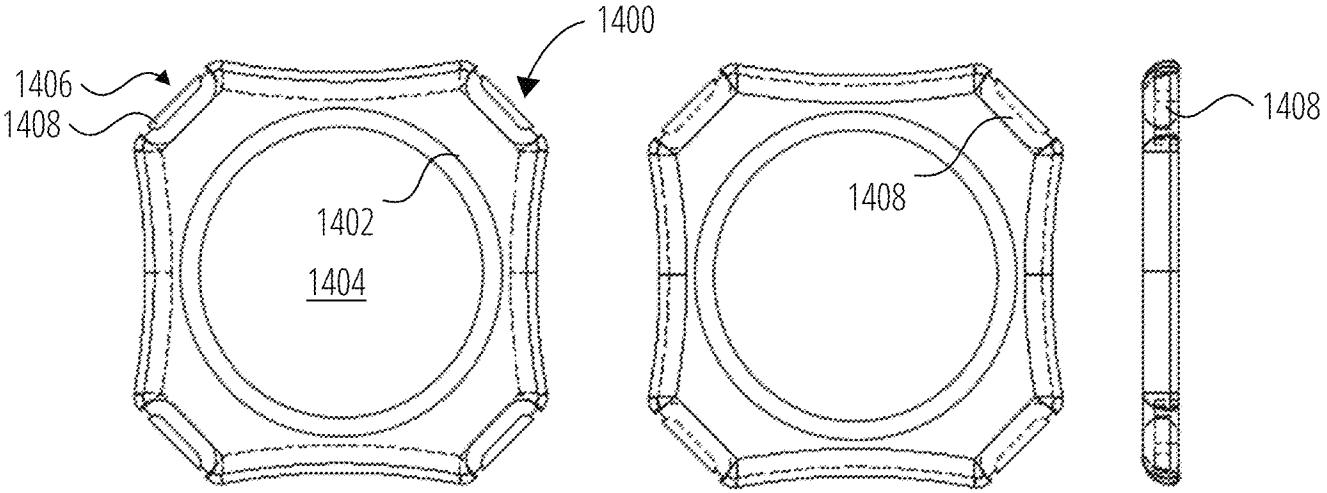
FIG. 14A
FIG. 14B
FIG. 14C
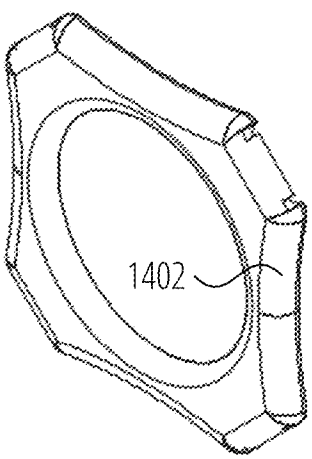
FIG. 14E
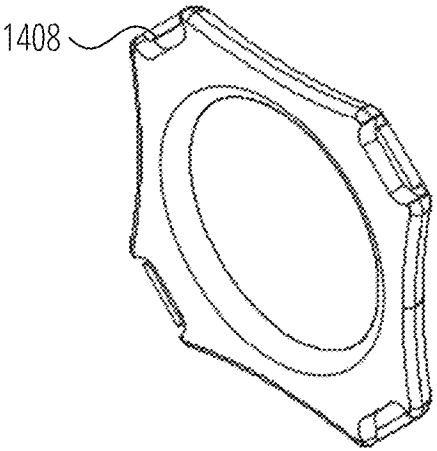
FIG. 14D

INTERFERENCE JOINT DIGITS, BUILDING ELEMENTS, BUILDING SYSTEMS, AND ASSEMBLIES

CROSS-REFERENCE TO RELATED APPLICATIONS

This application is a continuation of International Application No. PCT/US23/68786, filed Jun. 21, 2023, which claims the benefit of U.S. Provisional Patent Application No. 63/354,187, filed Jun. 21, 2022, both of which are hereby incorporated by reference in their entireties.

TECHNICAL FIELD

The present disclosure relates to the field of toys.

BACKGROUND

Foldable structures include, for example, the Hoberman sphere described in U.S. Patent Application Publication No. US2002/0083676A1. The Hoberman sphere is an isokinetic structure comprising joined links. The scissor-like joints connecting the links allow the spherical structure to be readily expanded and contracted by outwardly pulling or inwardly pushing the structure, respectively. A user can manipulate the Hoberman sphere along a continuum between the expanded and contracted configurations. However, the Hoberman sphere is limited to a single degree of freedom due to all of the joints in the Hoberman sphere being required to move when the sphere is transitioned between states.

There is a need for toys capable of being assembled into reconfigurable assemblies with greater degrees of freedom and additional entertaining characteristics.

BRIEF SUMMARY

The present disclosure provides toys including fidgets, building elements, building sets, and assemblies. The fidgets are referred to herein as "digit toys" or simply "digits" (alternatively, "links") and the category "building elements" includes both digits, links, and "hubs." The building elements may be provided individually or as a building set (a kit of building elements) and assembled into toy assemblies offering numerous advantages over known structures.

In contrast to the Hoberman sphere, toy assemblies of assembled building elements of the present disclosure have multiple degrees of freedom. That is, a user can manipulate the building elements independently. More specifically, each digit or link can be individually transitioned between at least a fully open configuration (i.e., a first state in which the joints of the link are longitudinally aligned), a fully closed configuration (i.e., a second state in which the segments of the digits are substantially parallel), and intermediate configurations between the fully open and fully closed configuration. Digits provided in this disclosure can also be inverted and/or transitioned from the fully open configuration, through a second intermediate configuration into a second closed configuration.

Further, optional interference joints of each digit stabilize the digit in the first state (longitudinally aligned state) and produce an entertaining "snap" or "pop" audible and/or tactile response when manipulated between the first state and the second state.

Assemblies of digits and hubs described herein have numerous degrees of freedom and can achieve different configurations which cannot be achieved by known systems. By way of example, an assembly including six digits such as assembly 2400 of FIG. 24A-FIG. 24B described below, results in over 1458 different configurations. An assembly including twelve digits (such as assembly 1900 of FIG. 19A-FIG. 19D) can be placed into 531,441 possible configurations. Naturally, the number of configurations continues to grow exponentially for more complex structures having a higher number of digits. As a result, when compared to conventional structures, such as the Hoberman sphere, implementations of this disclosure are more versatile and provide substantially more playability.

In an aspect, the present disclosure describes building elements referred to as "digits" configured to provide a tactile snapping or popping response to being bent into different configurations. Such digits provide entertainment individually, and may optionally be provided with other digits and/or other building elements (e.g., "hubs") to form building sets which include a digit and at least one other building element (such as another digit or a hub). Further, digits may be coupled to other digits and/or other construction elements (including hubs) to create assemblies having a number of interesting properties. In certain implementations, one or more digits may be fixed to other building elements into a complete, three-dimensional assembly. In other implementations, digits, hubs, and other components may be provided as a building set of disassembled building elements, partially assembled assemblies (e.g., a lattice), or fully assembled assemblies, which a user may assemble or reassemble into different assemblies. This disclosure provides various non-limiting examples of digits, hubs, and related assemblies.

In addition to being an outlet for creative play, digits according to this disclosure are also sensory "fidgets," particularly due to the tactile snapping/popping response they produce. Fidgets help improve concentration, attention to tasks, and self-regulation by allowing the brain to filter out extra sensory information and, as a result, have a broad range of applications for both children and adults. For example, fidgets are often used to improve listening in classroom settings, enhance focus during business meetings, and reduce anxiety and stress.

In an aspect, the present disclosure provides digits or digit toys, each of which includes a first segment and a second segment connected by a joint optionally comprising a living hinge, wherein interference members of the joint interfere as the joint transitions between a first state and a second state. Optionally, the first segment and the second segment each comprise a first retention feature disposed on a same first side thereof, wherein the first retention features reversibly retain the first segment to the second segment in the second state.

In another aspect, the present disclosure provides a toy (e.g., a fidget toy), which includes an assembly comprising a plurality of hubs coupled with a plurality of digits, wherein each digit comprises a first segment and a second segment connected by a joint optionally comprising a living hinge, wherein interference members of the joint interfere as the joint transitions between a first state and a second state. Optionally, the first segment and the second segment each comprise a first retention feature disposed on a same first side thereof, wherein the first retention features reversibly retain the first segment to the second segment in the second state, wherein the assembly comprises two or more independent degrees of freedom.

In another aspect, the present disclosure provides a toy (e.g., a fidget toy), which includes an assembly comprising a plurality of hubs coupled with a plurality of digits, wherein each digit comprises a first segment and a second segment connected by a joint optionally comprising a living hinge, wherein interference members of the joint interfere as the joint transitions between a first state and a second state. Optionally, the first segment and the second segment each comprise a first retention feature disposed on a same first side thereof, wherein the first retention features reversibly retain the first segment to the second segment in the second state. Optionally, the assembly is configurable between a plurality of stable closed configurations and a plurality of unstable closed configurations.

In another aspect, the present disclosure provides a building set, which includes a digit comprising a first segment and a second segment connected by a joint optionally comprising a living hinge, wherein interference members of the joint interfere as the joint transitions between a first state and a second state. Optionally, the first segment and the second segment each comprise a first retention feature disposed on a same first side thereof, wherein the first retention features reversibly retain the first segment to the second segment in the second state, wherein the first segment and the second segment each comprise a hub coupling feature disposed at a distal end thereof, and a hub defining a plurality of digit coupling features disposed around a body, wherein the hub coupling features reversibly connect with the digit coupling features.

The following features may be incorporated with any of the foregoing aspect, in any combination.

In any embodiment, the interference members comprise interlocking ends of the first segment and the second segment.

In any embodiment, the interlocking ends define a socket and a protrusion.

In any embodiment, the interference members comprise a plurality of links, each link extending from an end of the first segment or the second segment.

In any embodiment, the interference members interfere when the joint is in the first state.

In any embodiment, in the first state, the first segment and the second segment are longitudinally aligned, wherein in the second state, the first segment and the second segment are out of longitudinal alignment.

In any embodiment, at least one of the interference members is pliable.

In any embodiment, the interference members release from interference as the joint transitions out of an interference state.

In any embodiment, the interference members release from interference when the first segment and the second segment form an interior angle below a flexion threshold.

In any embodiment, the interference members deform to release.

In any embodiment, the release of the interference members produces an audible pop response.

In any embodiment, the release of the interference members produces a tactile pop response.

In any embodiment, the living hinge is offset from a midplane of at least one of the first segment or second segment.

In any embodiment, the first segment and the second segment each comprise a second retention feature disposed on a same second side thereof, wherein the second retention features are configured to reversibly retain the first segment to the second segment.

In any embodiment, the first segment and the second segment each comprise a coupling feature formed as a projection or a recess disposed at a distal end thereof.

In any embodiment, the digit further includes a third segment connected to the second segment by a second joint, wherein second interference members of the second joint are configured to interfere as the second joint transitions between a first state and a second state.

In any embodiment, in each of the stable closed configurations, the plurality of digits is stabilized in the first state or the second state.

In any embodiment, in each of the unstable closed configurations, at least one digit of the plurality of digits freely bends about the joint.

In any embodiment, the toy is configured to be turned inside out without uncoupling any of the digits from the hubs.

In any embodiment, wherein the digit and the hub form a lattice, wherein the hub coupling features and the digit coupling features are coupled together.

In any embodiment, the hub coupling features and the digit coupling features comprise complementary structures, including: slots and tabs or ball joints and sockets.

Additional advantages will become apparent from the following description.

BRIEF DESCRIPTION OF THE DRAWINGS

To easily identify the discussion of any particular element or act, the most significant digit or digits in a reference number refer to the figure number in which that element is first introduced.

FIG. 1C-FIG. 1F show additional views of the digit of FIG. 1A.

FIG. 14A-FIG. 14E show various views of a hub according to still another embodiment of the present disclosure.

DETAILED DESCRIPTION

Figures 1A, 1B:
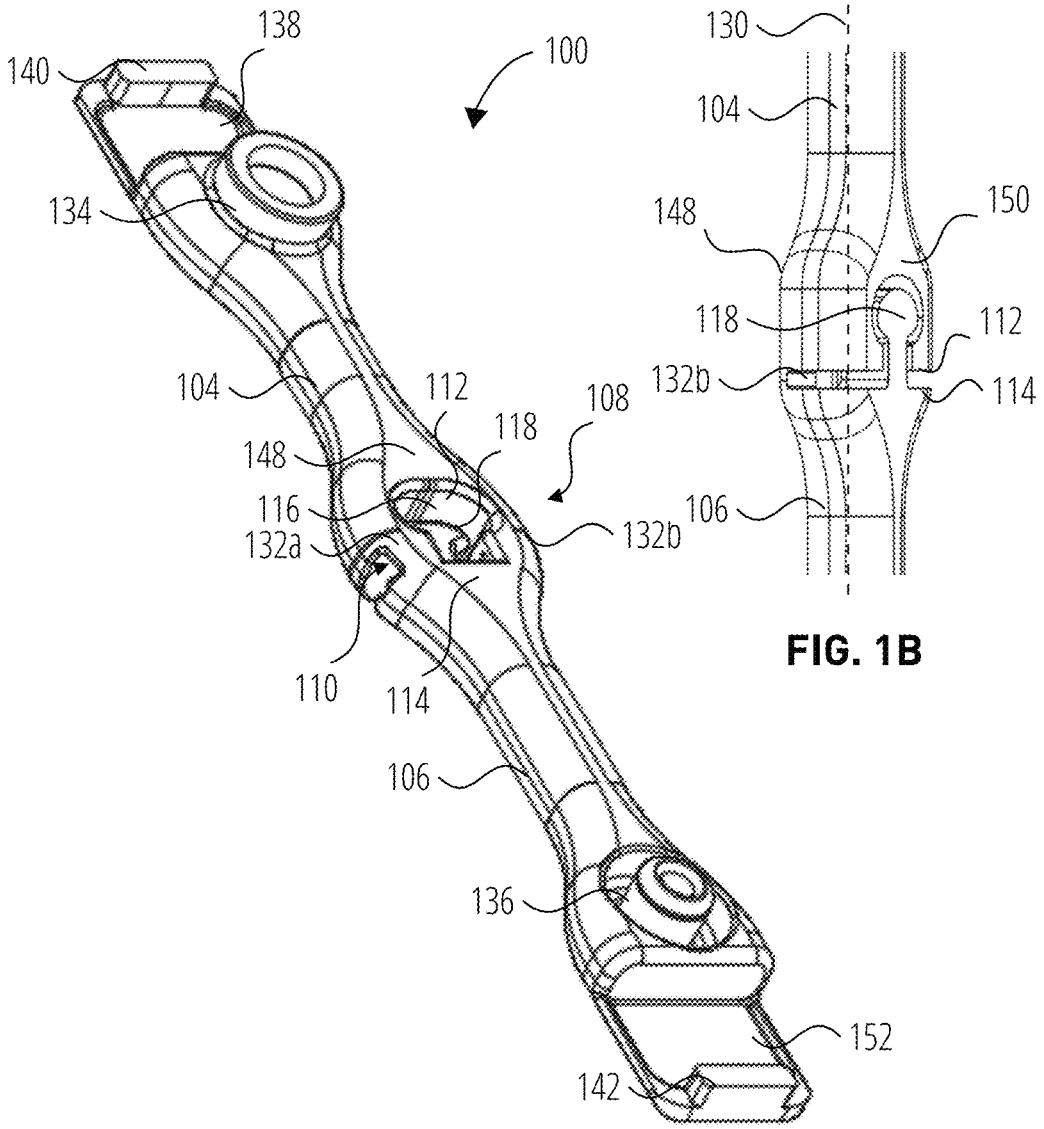
FIG. 1A-FIG. 1B show a perspective view and detail view of a digit according to one embodiment of the present disclosure.

FIG. 1A-FIG. 1B show one representative building element of the present disclosure referred to herein as a digit toy or digit 102. The digit 102 is configured to function in multiple capacities. Firstly, the digit 102 taken alone is a fidget or a toy. Secondly, the digit 102 can be a building element of a building set (i.e., a kit of two or more building elements). Third, the digit 102 can be a link of an assembly of building elements, i.e., a link of a fidget toy. The term "digit" is used herein to describe structures suitable for all such purposes.

Digit 102 includes a first segment 104, a second segment 106, and a joint 108 disposed between first segment 104 and second segment 106. Joint 108 includes a hinge 110 extending between and coupling first segment 104 to second segment 106. Joint 108 further includes an end 112 of first segment 104 and an end 114 of second segment 106. Joint 108 is an "interference joint" as described below; however, other embodiments of the building elements of the present disclosure utilize non-interference joints. See, e.g., FIG. 6A-FIG. 6D. In FIG. 1A, hinge 110 is a living hinge formed by two bridging strips 132*a*, 132*b* of material that connect ends 112, 114. Strips 132*a*, 132*b* are also offset from longitudinal centerline 130, thus enabling the joint 108 to bend more easily in one direction (i.e., from the first state to the second state). In other embodiments, the hinge 110 may have a construction other than a living hinge, e.g., an internal hinge sandwiched between two halves of the digit as described in International Patent Publication No. PCT/IB2021/061868 to Hoenigschmid, which is herein incorporated by reference in its entirety. In some embodiments, hinge 110 is formed integrally with the interference members of the joint 108, which are described below.

During use, a user can transition digit 102 between various states by bending digit 102 at joint 108. This disclosure generally discusses transition of digits between a first state and a second state. The first state and the second state can be characterized by the position of the joint 108 and/or the relative positions of the segments 104, 106.

In some embodiments, the first segment and the second segment have different relative alignments in each of the first state and the second state. In some embodiments, the first state is an extension state (see FIG. 1A) and the second state is a flexion state (see FIG. 2C and FIG. 2D), which may be ascertained with reference to the joint 108 alone, or with reference to the segments 104, 106. In certain embodiments, the first state may correspond to a state in which first segment 104 and second segment 106 are longitudinally aligned (e.g., as shown in FIG. 1A-FIG. 2B) and the second state may correspond to a state in which first segment 104 and second segment 106 are out of longitudinal alignment, up to and including being substantially parallel to each other (e.g., as illustrated using various example digits in FIG. 2C-FIG. 2D).

For ease of understanding, the first state is frequently referred to herein as a "longitudinally aligned state" or an "extension state" in which the first segment and second segment are longitudinally aligned, whereas the second state is referred to as a "flexion state" or a "parallel segments state" in which the first segment and second segment are substantially parallel. However, the principles and concepts disclosed herein may be readily adapted to embodiments in which segments are angled (i.e., oblique or perpendicular) relative to each other in one or both of the first and second state.

As digit 102 transitions between a first state and a second state, interference members of the joint 108 are configured to interfere with each other in an "interference state" through an interference range of motion, deform (in some embodiments), and then release (i.e., pass each other, substantially reduce friction or resistance, or otherwise release engagement or significantly reduce interference) beyond the interference range. As described below, the interference state is a stabilized state resulting from mechanical, magnetic, or other interference between interference members. Restated, "interference" means, for example, rubbing, interlocking, rolling against, magnetically repelling or attracting, or otherwise resisting relative bending of the joint. When any digit described herein is not in the interference state or in another stabilized state where the segments are coupled together by retention features or otherwise stabilized, then the segments are in a free state or relaxed state in which the digit is generally free to rotate about the joint with minimal or nominal resistance except for any biasing imparted by the hinge 110 or production process.

The range of motion in which the interference members interfere is referred to as the interference range of the interference state which, as described above, may at least partially coincide with the first state (extension state) and the second state (flexion state). In some embodiments such as the digit 102 of FIG. 1A-FIG. 1B, the interference state at least partially overlaps the first state (but not the second state); in such embodiments, the interference members interference when the segments are in the longitudinally aligned state. In some embodiments, the interference state exists between (e.g., entirely between) the first state and the second state; in such embodiments, the interference members do not interference when the segments are in the longitudinally aligned state. In some embodiments, the interference state at least partially overlaps the second state (but not the first state); in such embodiments, the interference members interference when the segments are in the parallel segments state.

With reference to the interior angle formed by segments of the digit (see, e.g., FIG. 2C), the interference range may be about 1-30 degrees, e.g., about 1-20 degrees, about 1-10 degrees, about 10-30 degrees, or about 10-20 degrees. Restated, the interference members continue to interfere until the segments 104, 106 form an interior angle less than about 150 degrees to 180 degrees (e.g., about 150-170 degrees, about 150-160 degrees, about 160-180 degrees, or about 170-180 degrees). When the segments 104, 106 form an interior angle below this flexion threshold, the interference members rapidly release and thereafter, the digit 102 can be bent into the second state with significantly less resistance.

In some embodiments, release of the interference members from the interference state produces a tactile and/or audible "snap" or "pop" response from the joint 108. The snap or pop response adds entertaining sensory feedback and encourages play. The extent to which end 112 interferes with end 114 in the interference state and the nature of the resulting snap/pop response, is a function of material selection and the geometry of ends 112, 114. For example, materials having a higher rigidity and interference members configured to interfere to a relatively high degree (e.g., due to shape and/or tighter tolerances) will produce a more pronounced snap/pop response than softer materials and interference member shapes configured to interfere minimally and/or to have relatively high flexibility. The joint 108 may be configured to produce a snap or pop response in a single direction (i.e., when the digit is manipulated from the first state to the second state or vice versa) or in both directions.

Referring to FIG. 1B, in the digit 102, the interference members include interlocking ends 112, 114, which may be pliable or otherwise configured to deform as the interference members interfere. More particularly, the interlocking ends 112, 114 include a socket 116 and a protrusion 118, respectively, which interfere with each other in the first state (longitudinally aligned state or extension state) and stabilize the digit 102 in that state.

In some embodiments such as the digit 102 of FIG. 1A, the interference members 116, 118 interfere with each other in both directions (i.e., when the digit 102 transitions from the first state to the second state and vice versa). In other embodiments, the interference members interfere with each other in a single direction, i.e., as the digit 102 transitions from the first state to the second state or vice versa.

As discussed below in further detail, digit 102 may at least partially be formed from a pliable material such that, if a user applies a sufficient bending force to digit 102 while end 112 and end 114 interfere with each other (i.e., in the interference state), then end 112 and/or end 114 undergo sufficient deformation such that ends 112, 114 release (i.e., pass each other or otherwise significantly reduce interference), enabling further transition of digit 102 into the first or second states. In some embodiments, the digit 102 is a unitary apparatus formed of a single material (e.g., an injection molded TPU). In other embodiments, the interference members are formed of a different material than the segments; for example, the digit 102 may be co-molded with two or more materials.

Referring to FIG. 1C-FIG. 1F, one representative interference member configuration will now be described. Digit 102 provides a first example of an interlocking interference member configuration wherein end 112 defines a claw, jaw, or socket 116 that receives a protrusion 118 of end 114, e.g., when digit 102 is in the first state. In digit 102, protrusion 118 has a "T" shape, mushroom-like shape, or bulbous shape. Socket 116 has a "C" or claw shape defining a cavity that receives and partially extends around protrusion 118 when digit 102 is in the first state.

Referring briefly to FIG. 1E, socket 116 interferes with protrusion 118 when the digit 102 transitions from the first state to the second state or vice versa (e.g., by bending in a direction 120 about joint 108 from the first state and a direction 122 about joint 108 from the second state. In particular, the socket 116 grips the protrusion 118 as shown in FIG. 1C-FIG. 1D and resists release thereof until sufficient bending force is applied to the segments 104, 106 that the socket 116 temporarily deforms or yields, allow the protrusion 118 to snap forth therefrom (producing the audible and tactile response).

As shown most clearly in FIG. 1E, the protrusion 118 has a partial depth or thickness relative to the depth of the segments 104, 106. In particular, the protrusion 118 has a depth that extends to the centerline 130 of the digit 102. The depth of protrusion 118 can be increased or decreased in different embodiments to modulate the snap or pop response. For example, in some embodiments, the protrusion 118 can have a depth that extends past the centerline 130, e.g., up to the full depth or thickness of the segments 104, 106; such embodiments would produce a more significant pop or snap response. On the other hand, in some embodiments, the protrusion 118 has a shallower depth, e.g., less than half of the depth or thickness of the segments 104, 106; such embodiments would produce a less significant pop or snap response.

Returning briefly to FIG. 1A, protrusion 118 has an optional radius formed around its perimeter on the first joint surface 148 and hinge 110, which facilitates movement of the digit 102 into the first state. As shown in FIG. 1B, the protrusion 118 does not have any similar radius formed on the side facing second joint surface 150 or away from hinge 110; however, other embodiments may include a radius on both sides.

Turning again to FIG. 1B, joint 108 may be configured to prevent hyperextension, e.g., beyond full extension. For example, hinge 110 is offset from centerline 130 or midplane, which causes ends 112, 114 to abut when the digit bends from the first state in an opposite direction from second state, thus preventing hyperextension. Restated, when longitudinally aligned, the segments 104, 106 define a longitudinal axis (parallel with the centerline 130) and the hinge 110 is offset from the longitudinal axis.

The interference members may have many additional different configurations. In other embodiments, the interlocking ends comprise one or more pairs of: a tongue and groove; hook and loop; ball and socket; parallel bosses; cams; a cam and a follower, or similar structures which mechanically engage each other and then release as the digit transitions between the first state and second state. In still other embodiments, the interference members may include two or more magnets lodged at distal ends of the segments 104, 106. Said magnets may have the same or opposite polarities. In such embodiments wherein the magnets have the same polarities, the magnets magnetically interfere by repelling each other in the interference range. In such embodiments wherein the magnets have opposite polarities, the magnets magnetically interfere by attracting each other and resisting bending of the digit 102 in the interference range.

In still other embodiments, the digit includes a single interference member in the form of a strip of spring steel or similar material which is biased toward the second state, similar to the tape of a tape measure. Said strip extends between the ends 112, 114 of segments 104, 106. The strip is curved along its width (shorter dimension), giving it a concave shape when extended. This curvature allows the strip to remain rigid when extended longitudinally (i.e., when the digit 102 is in the first state). However, when sufficient bending force is applied, the strip snaps the segments 104, 106 bend into the second position.

Digits according to the present disclosure may include various other features to enable coupling with other digits and building elements in order to form assemblies. In some implementations, a digit may include features for retaining the digit in particular states or for maintaining the segments of the digit in particular relative orientations. For example, referring back to FIG. 1A, first segment 104 includes a retention feature 134 (e.g., a snap, coupling, latch, magnet, press-fit coupling, ball-socket fitting, or similar feature) which is positioned and shaped to couple with and be retained by a complementary retention feature 136 positioned on the second segment 106. Retention features 134, 136 are disposed on a same first side of the respective segments 104, 106 and at locations along the segments 104, 106 such that the retention features 134, 136 couple together when the digit 102 is in the second state.

When coupled together, the retention features 134, 136 maintain the digit 102 in a stabilized state in which the first segment 104 couples to and is substantially parallel with second segment 106, e.g., a second state or parallel segments state. See FIG. 2D.

FIG. 2A-FIG. 2D illustrate digits transitioning between respective first states (e.g., longitudinally aligned states), through an intermediate state, and into a second state (e.g., a parallel segments states). In the embodiments shown in FIG. 2D, the second state is characterized by the coupling of retention features of the respective digits to maintain the segments thereof in a parallel orientation.

Returning to FIG. 1A-FIG. 1B, in addition to maintaining first segment 104 and second segment 106 in relative positions and orientations, retention feature 134 and retention feature 136 may be configured in any embodiment to produce an additional tactile and/or audible "popping" or "snapping" response when coupled and/or decoupled from each other. For example, in some embodiments, retention features 134, 136 have a complementary detent and notch that produce the pop or snap response.

While retention features 134, 136 of digit 102 are shown as mating structures, in other implementations, such structures may be supplemented or replaced by other mechanisms for retaining first segment 104 relative to second segment 106. For example, in some implementations, retention features 134, 136 are magnets disposed on the surface of or embedded within segments 104, 106, respectively. In some embodiments, retention features 134, 136 are adhesive patches, hook-and-loop fasteners, or other reversible retention feature. In some embodiments, retention features 134, 136 accommodate a third element (e.g., a pin) separate from digit 102 to retain first segment 104 relative to second segment 106. In some embodiments, retention features 134, 136 collectively form a loop, snap, buckle, clip, or similar retaining structure.

Digits according to the present disclosure may include a retention feature on a single segment, e.g., either the first segment 104 or second segment 106. For example, retention feature 134 can be a strap that may be extended or wrapped around second segment 106 when first segment 104 and second segment 106 are in a parallel orientation; in such embodiments, the second segment 106 does not include retention feature 136. Considering the foregoing, digits according to this disclosure may include any suitable structure configured to maintain first segment 104 in a position or orientation relative to second segment 106.

A digit may include additional features for connecting the digit to one or more other structure or components including, but not limited to, other digits. In some embodiments, such interconnecting functionality is provided by the retention features of the digit. For example, retention feature 134 of a first digit may be coupled to retention feature 136 of a second digit, retention feature 134 of the second digit may be coupled to retention feature 136 of a third digit, and so on, to form a chain of digits linked by their respective retention features.

In addition to retention features, digits may optionally include additional features to facilitate coupling of the digit to other building elements (e.g., other digits and/or hubs), whether reversibly (as with mechanical interconnections) or permanently (e.g., by adhesive, welding, melting, etc.). Such features are generally referred to as coupling features or connection features herein, and may be selectively referred to as digit coupling features and hub coupling features. Due to their respective structure and placement, coupling features of any embodiment described herein may be alternatively referred to and claimed as pull tabs, i.e., tabs that facilitate the separation of the digits from the second state.

The coupling features may be formed, for example, as projections or recesses. For example, referring back to FIG. 1A, in the context of digit 102, first segment 104 includes a coupling feature 140 disposed at a distal end 138 of first segment 104, and second segment 106 includes coupling feature 142 disposed at a distal end 152 thereof. Each of coupling features 140, 142 are projections (in this embodiment, tabs) that may be inserted into, adhered to, welded to, or otherwise attached to corresponding slots, recesses, or surfaces of other building elements (either permanently or reversibly). More generally, the coupling features 140, 142 may be complementary male/female counterparts or other interlocking structures. Such coupling features enable the accurate placement and secure connection of digits and hubs in assemblies as described below.

In other instances, coupling features may facilitate temporary or selective coupling of digits to other building elements. For example, coupling features may include magnets, press fit structures, hook-and-loop fasteners, any retention features described herein, or other similar structures that can be connected, disconnected, and reconnected as needed. Such coupling features may be implemented, for example, when digits are part of a building set intended to be assembled and disassembled into different structures. As described below, the present disclosure provides such building sets comprising a plurality of building elements.

Some embodiments include different coupling features on different ends of the segments. For example, a digit may include a tab-style coupling feature at a distal end of a first segment and a ball joint or socket at a distal end of the second segment.

In some embodiments, the interference members may also function as coupling features. For example, when digit 102 is configured such that first segment 104 and second segment 106 are substantially parallel, each of end 112 and end 114 are exposed. Digit 102 may then be coupled to another building elements by inserting end 112 and end 114 into corresponding structures of the building element (e.g., complementary sockets and recesses). For example, end 112 and end 114 of a first digit may be inserted into end 114 and end 112 of a second digit, respectively, to couple the first digit to the second digit. This coupling concept is illustrated and discussed below in further detail in the context of FIG. 8A-FIG. 8F, below.

Digits and Digit-Based Structures

The foregoing concepts for digits according to the present disclosure can be incorporated and modified into a wide range of digit designs. This section provides various examples digits and digit assemblies and highlights various features of the example designs. The example implementations are intended to be non-limiting and illustrative of the concepts discussed herein. Concepts included in any of the example implementations may be combined or modified to arrive at designs not specifically illustrated or discussed herein. For example, a digit may include any combination of interference joints, coupling features, and/or retention features. As another example, a digit may include an interference joint and retention features, but not coupling features. As still another example, a digit may include structures other than coupling features at one or more of its distal ends, e.g., living hinges connecting the digit directly to other building elements, such as hubs.

Figure 2A:
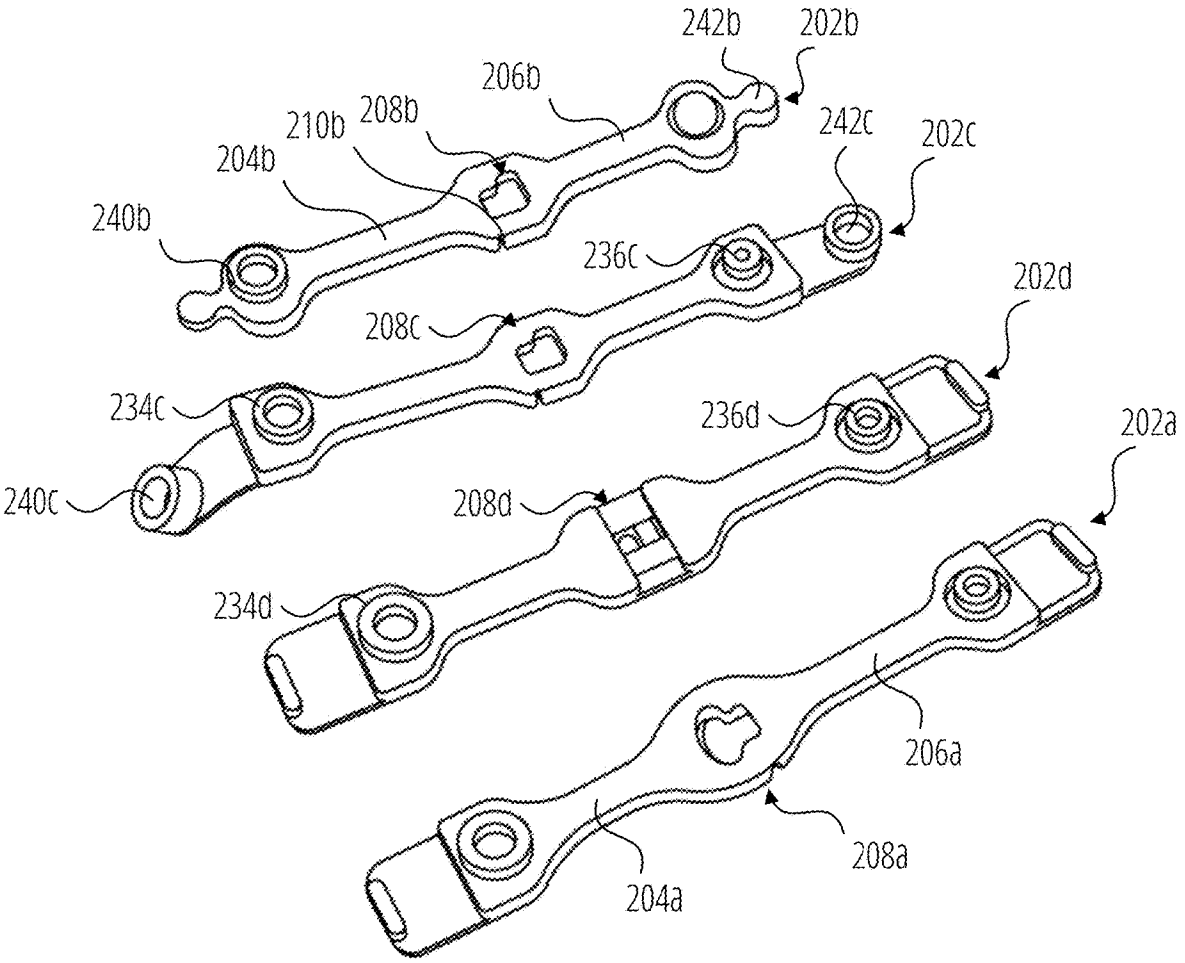
FIG. 2A-FIG. 2D show various views of digits according to additional embodiments of the present disclosure.
Figure 2B:
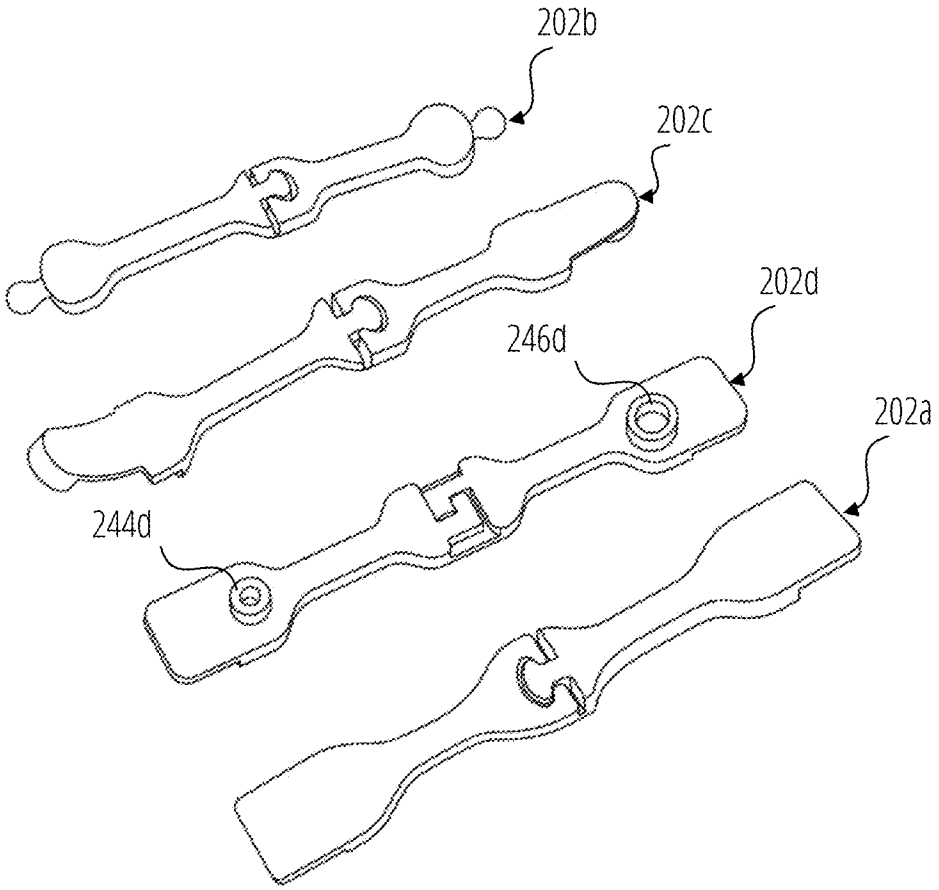
Figure 2C:
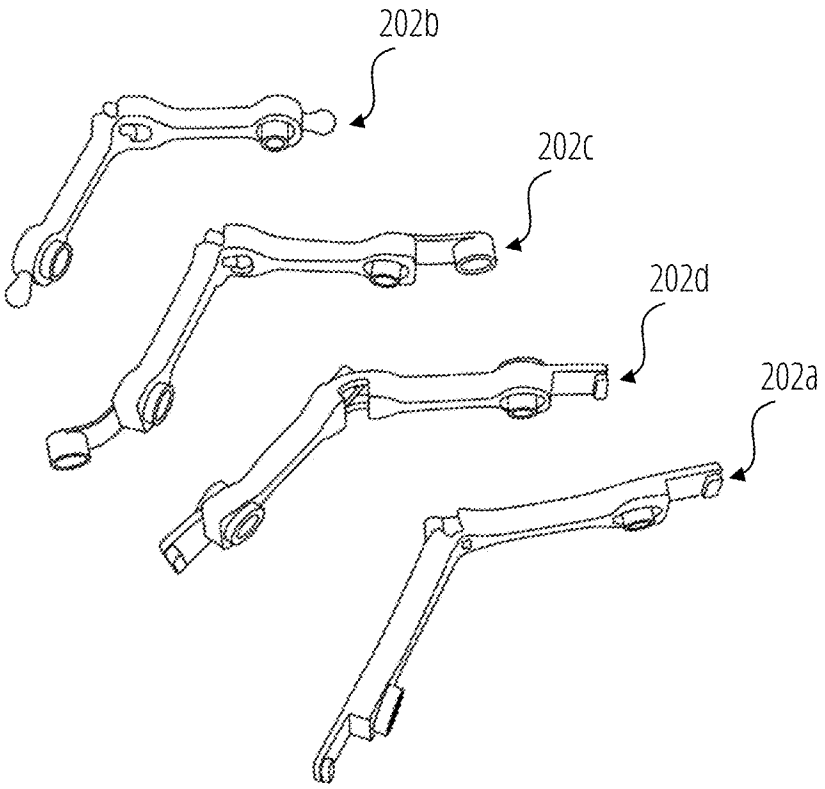
Figure 2D:
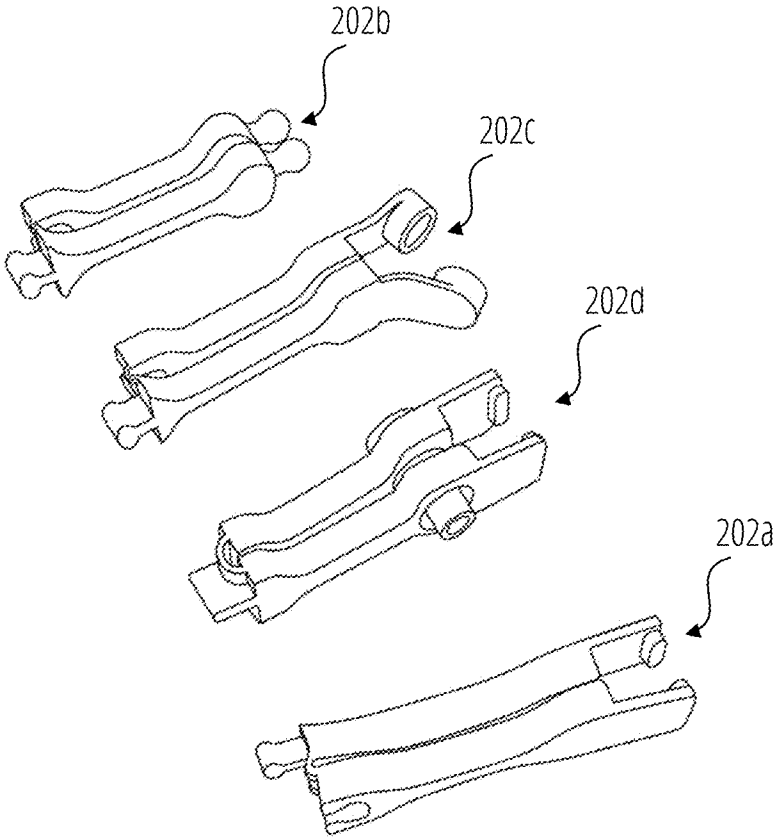

FIG. 2A-FIG. 2D illustrate a collection of digits according to this disclosure. In particular, FIG. 2A and FIG. 2B illustrate the front and back of the digits in an open configuration or extension state, which may generally correspond to a first state of the digits. FIG. 2C illustrates the digits in a partially folded/bent configuration, which may correspond to an intermediate state of the digits or a flexion state. In any embodiment, the digit may be biased toward a flexion state as shown in FIG. 2C. Such biasing may be imparted by the interference joint (e.g., a protrusion resists entry into the corresponding socket, biasing the digit toward the flexion state). Additionally or alternatively, the biasing may be imparted by a molding or other production process of the digit. Referring to FIG. 2D, the digit may be further bent, such as into the fully folded flexion state or parallel segments state.

Figure 10A:
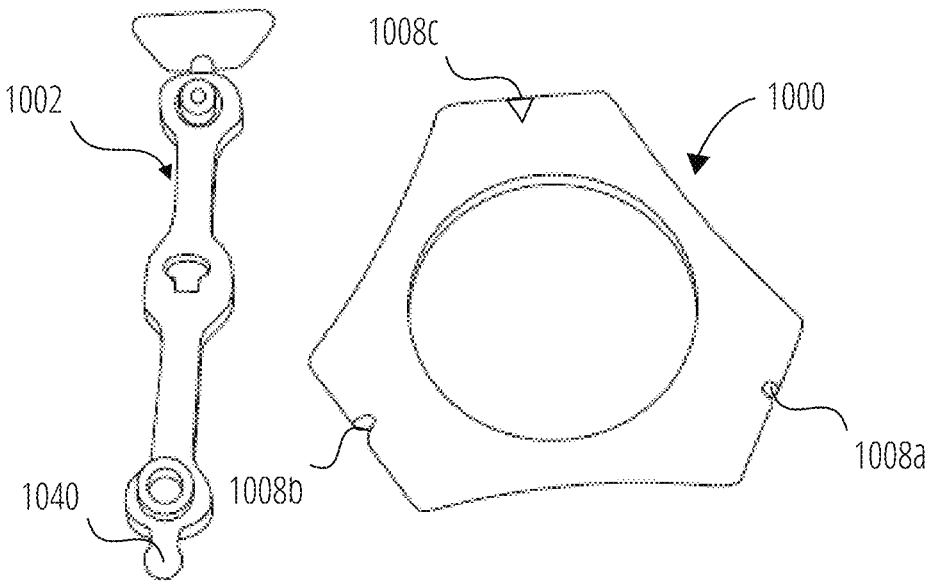
FIG. 10A-FIG. 10B show an alternative coupling structure between a digit and a hub.
Figure 10B:
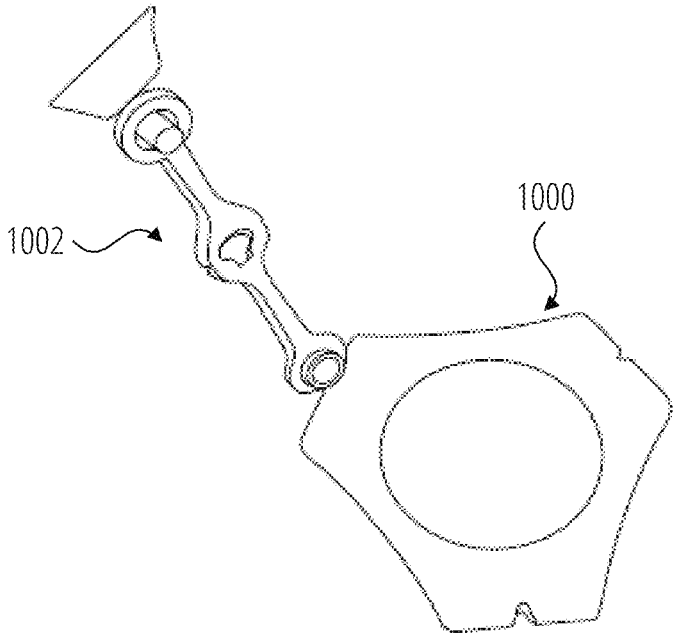

FIG. 2A-FIG. 2D show digit 202*a*, which is the same as digit 102 of FIG. 1A. FIG. 2A-FIG. 2D also include a first alternative digit 202*b*, which is similar to digit 202*a*. In contrast to digit 202*a*, which includes tab-style coupling features, digit 202*b* includes ball type coupling features 240*b*, 242*b*, wherein each coupling feature is a ball-shaped protrusion joint configured for coupling with a corresponding socket of another component (e.g., as shown in FIG. 10A and FIG. 10B). Such ball-type joints enable axial rotation and movement of the digit 202*b* when coupled to another component. In other embodiments, the digit includes socket-type coupling features, rather than ball-type.

FIG. 2A-FIG. 2D also include a second alternative digit 202*c*, which is similar to digit 202*a* and is particularly well suited as a fidget. In contrast to digit 202*a*, digit 202*c* includes press-type coupling features 240*c*, 242*c*, each of which is a ring-shaped protrusion (although any suitably shaped protrusion may be used instead). The coupling features 240*c*, 242*c* also function as pull tabs to facilitate the separation of the segments of digit 202*c* from the second state. In some embodiments, coupling features 240*c*, 242*c* may be blind or open, and may be shaped to press fit with retention features 234*c*, 236*c*, respectively. Some embodiments include one or more rings as coupling features 240*c*, 242*c*, e.g., to facilitate connection to a keychain.

FIG. 2A-FIG. 2D also include a third alternative digit 202*d*, which is similar to digit 202*a*. In contrast to joint 108 of digit 102 of FIG. 1A, joint 308*d* of 202*d* allows for bidirectional bending from the first state (longitudinally aligned state). Stated differently, when digit 202*d* is in the first state (e.g., with first segment and second segment aligned), digit 202*d* may be bent about 208*d* in a first direction to transition into the second state or may be bent in a second direction opposite the first direction to transition into a third state that is similar to, but opposite the second state. When in the third state, digit 202*d* may be fully bent into in a folded configuration, similar to that shown in FIG. 2D. Referring to FIG. 2B, in some embodiments, the first segment and the second segment each comprise a second retention feature disposed on a same second side thereof, wherein the second retention features are configured to reversibly retain the first segment to the second segment. For example, digit 202*d* may include retention features 244*d*, 246*d* disposed on opposite side of the respective segments from retention features 234*d*, 236*d*, and which may be coupled together to retain digit 202*d* in a folded configuration.

Figure 3A:
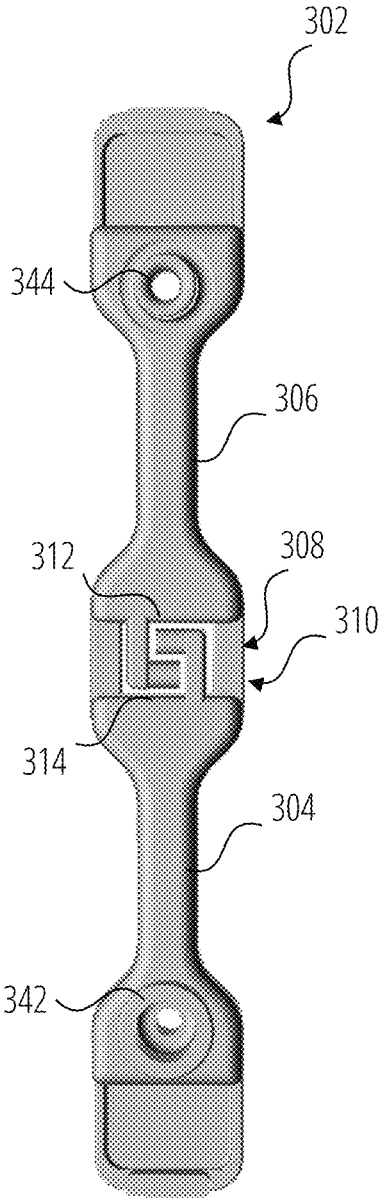
FIG. 3A-FIG. 3C show various views of a digit according to another embodiment of the present disclosure.
Figure 3B:
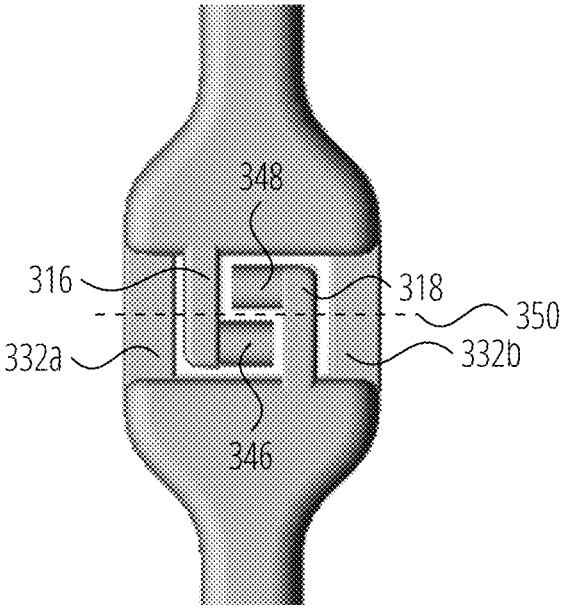
Figure 3C:
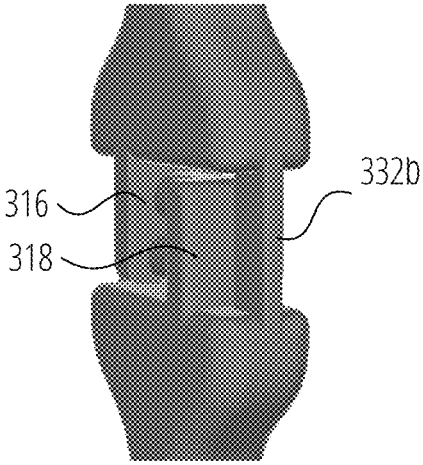
Figure 4A:
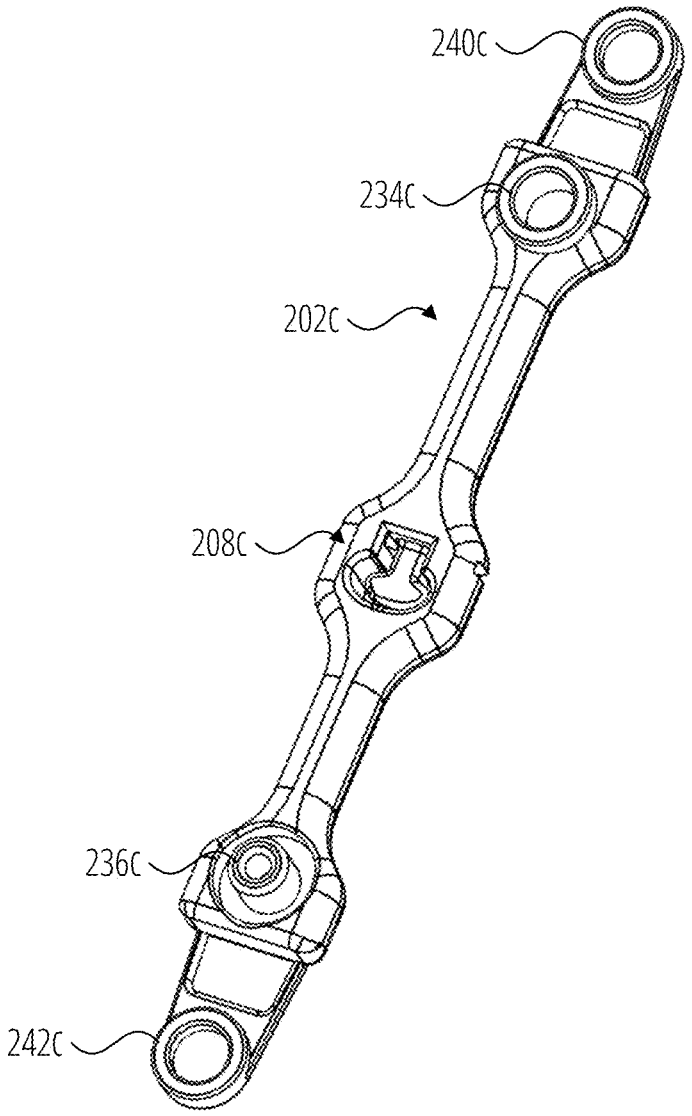
FIG. 4A-FIG. 4D show various views of a digit according to still another embodiment of the present disclosure.
Figure 4D:
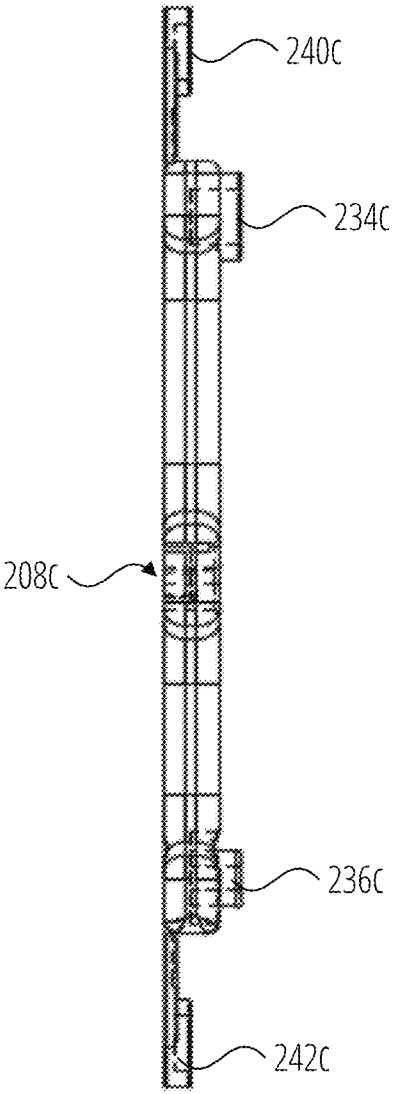
Figure 4C:
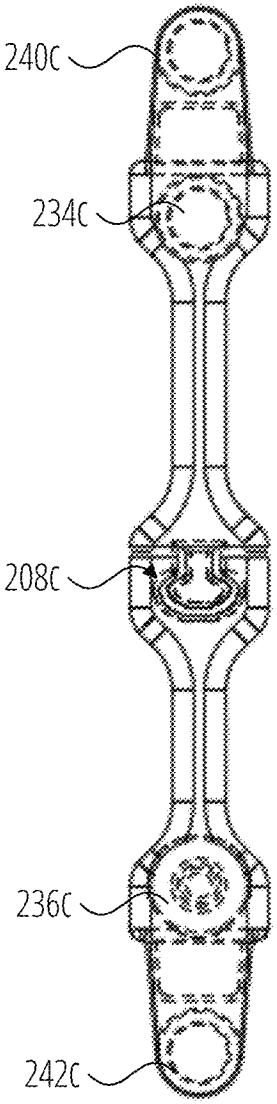
Figure 4B:
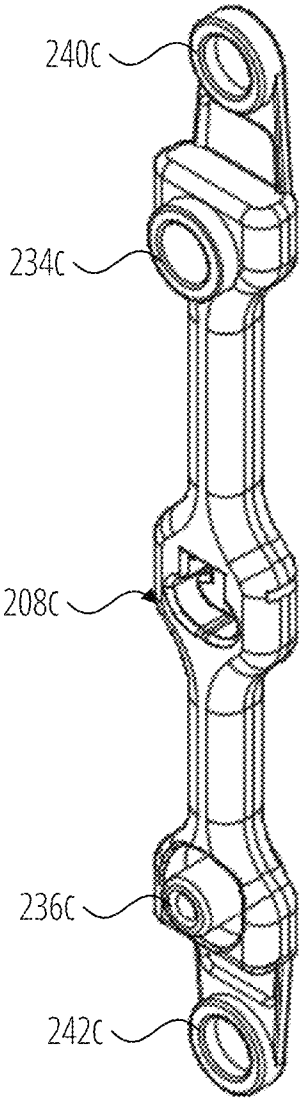
Figure 5D:
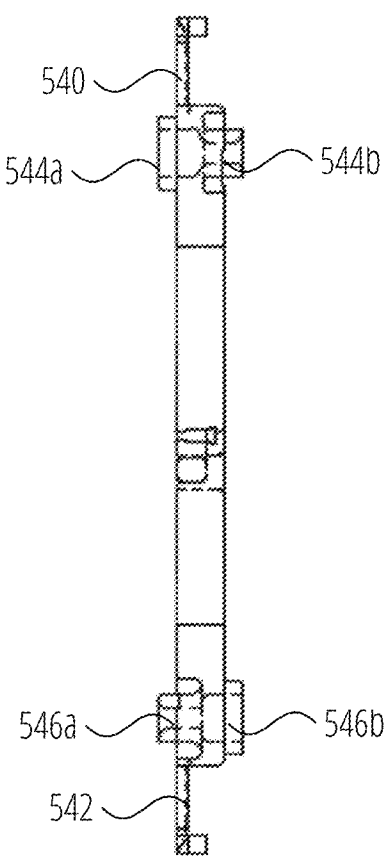
FIG. 5A-FIG. 5D show various views of a digit according to still another embodiment of the present disclosure.
Figure 5C:
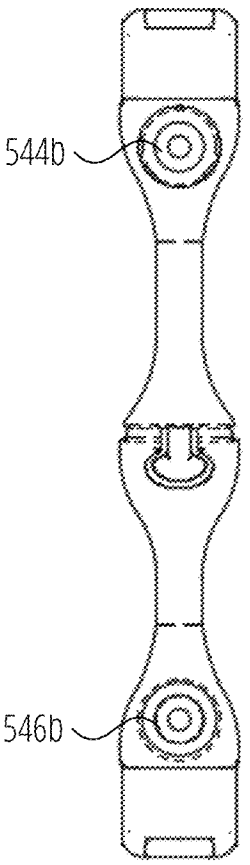
Figure 5B:
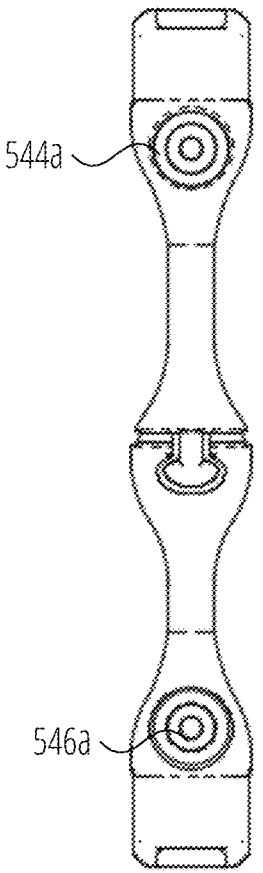
Figure 5A:
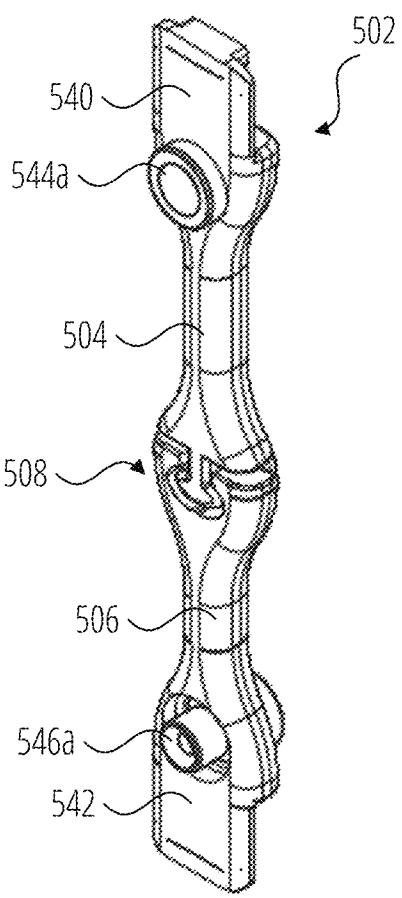
Figure 6D:
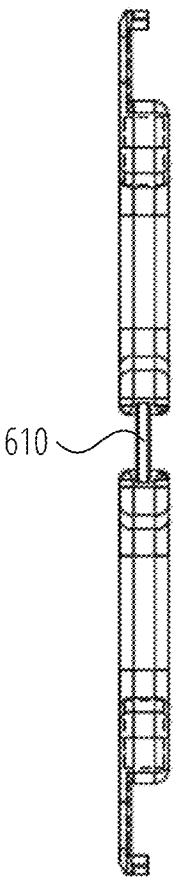
FIG. 6A-FIG. 6D show various views of a digit according to still another embodiment of the present disclosure.
Figure 6C:
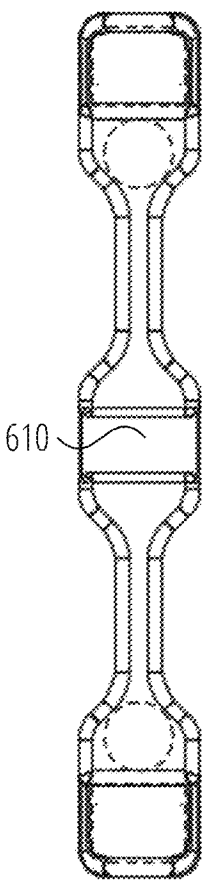
Figure 6B:
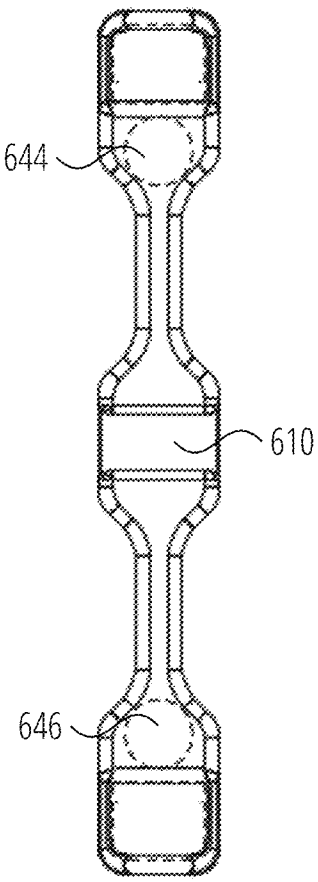
Figure 6A:
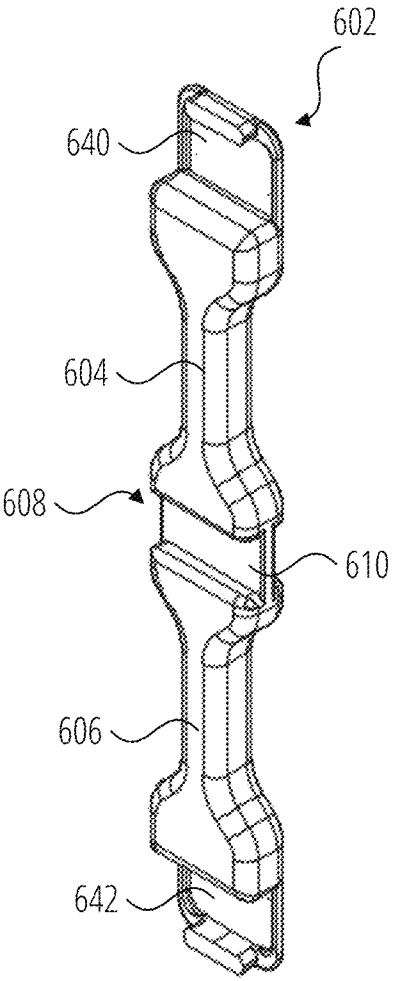

FIG. 3A-FIG. 3C show a digit 302 which is the same as digit 202*d* of FIG. 2A-FIG. 2D, and therefore includes a bi-directional interference joint 308. Although other bi-directional joint configurations are possible using the structures described above, in at least one implementation, joint 308 includes interlocking ends comprises a plurality of links, each link extending from an end of the first segment or the second segment. In particular, a link 316 extends from end 312 of first segment 304 and a link 318 extends from end 314 of second segment 306. The links 316, 318 respectively comprise bosses 346, 348 extending away therefrom. In the illustrated embodiment, the bosses 346, boss 348 are parallel to each other and parallel to a joint axis 350. Each of the bosses 346, 348 has a cylindrical cross-sectional shape, but may have an eccentric shape or other shape in different embodiments.

When in the first state (i.e., in a state in which the segments 304, 306 are longitudinally aligned), links 316, 318 overlap but are not in contact with each other. As digit 302 is bent from the first state into the second state (e.g., out of the page in the perspective of FIG. 3A) or from the first state into the third state (e.g., into the page in the perspective of FIG. 3A), link 316 and link 318 contact and interfere which each other in the interference state. As digit 302 is further bent, link 316 and link 318 deform and eventually pass each other, resulting in a tactile and/or audible "snap" or "pop" and transition into the second or third state. To further facilitate bi-directional bending of digit 302, hinge 310 includes parallel strips 332*a*, 332*b* extending along the midplane of digit 302 (see FIG. 3C).

FIG. 4A-FIG. 4D show additional views of digit 202*c* of FIG. 2A-FIG. 2D. The joint 208*c* is the same as joint 108 of digit 102 of FIG. 1A.

FIG. 5A-FIG. 5D illustrate an alternative digit 502 according to this disclosure. Digit 502 combines features of various digits discussed previously in this disclosure. Digit 502 includes a first segment 504 coupled to a second segment 506 by a joint 508, which can take the form of any joint discussed herein but is shown as being substantially similar to joint 108 of digit 102 of FIG. 1A.

Like previously discussed digits, digit 502 can be manipulated by bending the segments 504, 506 about joint 508. Like digit 102, digit 502 is configured to bend in one direction. Nevertheless, digit 502 includes two sets of retention features. Specifically, digit 502 includes retention features 544*a*, 546*a* on a first side of digit 502 and retention features 544*b*, 546*b* disposed opposite retention features 544*a*, 546*a*, respectively.

During use, digit 502 can be bent at joint 508 to couple retention features 544*a*, 546*a*; however, digit 502 cannot generally be bent to couple retention features 544*b*, 546*b*. Accordingly, retention features 544*b*, 546*b* are intended for coupling of digit 502 to other components (e.g., digits or hubs).

Digit 502 further includes coupling features 540, 542, which can be used to couple digit 502 to other digits, hubs, etc. Coupling features 540, 542 are shown as tabs; however, those features may be substituted with any other type of coupling feature discussed or otherwise suitable for the purposes described herein.

FIG. 6A-FIG. 6D illustrate an alternative digit 602 according to this disclosure. Digit 602 is similar to digit 102 of FIG. 1A and includes a first segment 604 coupled to a second segment 606 by a joint 608 including a living hinge 610. Digit 602 can be manipulated by bending segments 604, 606 about joint 608. Unlike previously described digits, joint 608 is not an interference joint, i.e., the ends of segments 604, 606 do not interfere when bending occurs. Consequently, the joint 608 does not produce an audible and/or tactile snap or pop response when bent.

Digit 602 is otherwise substantially similar and incorporates various aspects of digits discussed herein. For example, digit 602 includes retention features 644, 646, which are magnets respectively embedded in segments 604, 606. Such an embedded magnet retention feature may be utilized in any digit described herein. In other implementations, the retention features 644, 646 may be replaced with other components, such as mating surface features.

Retention features 644, 646 may couple with each other to maintain digit 602 in a folded state regardless of which direction the digit 602 is bent about the joint 608. Retention features 644, 646 may also facilitate coupling of digit 602 with other digits, hubs, and the like.

Digit 602 further includes coupling features 640, 642 which can be used to couple digit 602 to other digits, hubs, etc. Coupling features 640, 642 are shown in FIG. 6A-FIG. 6D as tabs; however, such features may be substituted with any other type of coupling feature discussed or otherwise suitable for the purposes described herein.

The foregoing digits each include a single joint disposed between two segments. In other implementations of the present disclosure, digits include two or more joints and coupling more than two segments together.

Figure 7A:
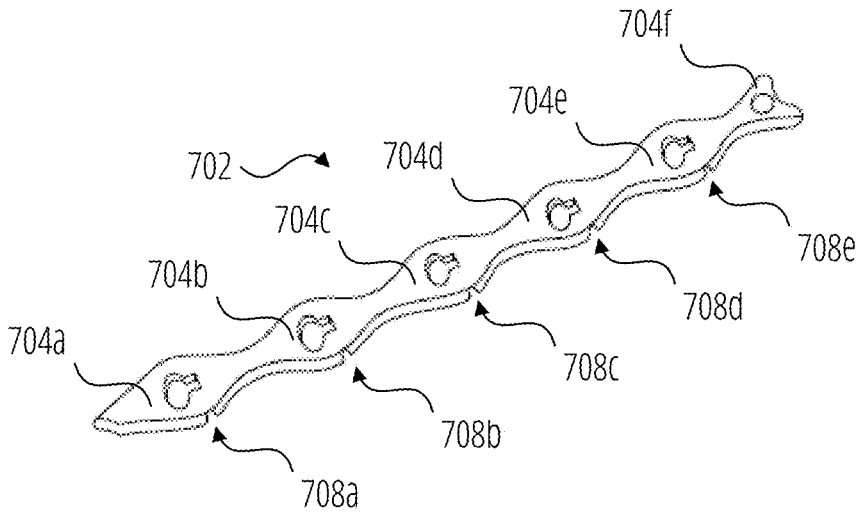
FIG. 7A-FIG. 7B show various views of a digit according to still another embodiment of the present disclosure.
Figure 7B:
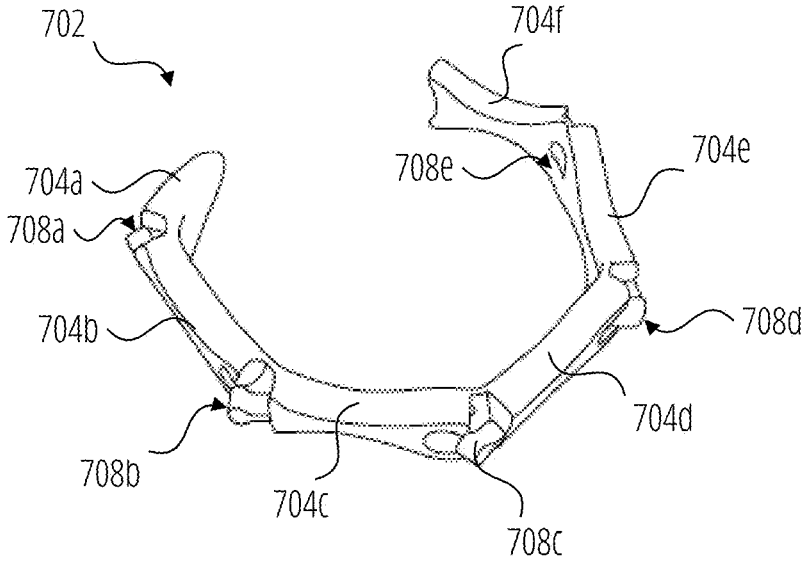

Referring to FIG. 7A-FIG. 7B, a digit 702 includes a chain or series of six segments 704*a*-704*f* sequentially coupled by five joints 708*a*-708*e* respectively adjoining adjacent segments. The number of segments and joints is representative, and other embodiments may include greater or fewer segments and joints.

Segments 704*a*-704*f* omit retention and coupling features for simplicity. However, one or more segments in any multi-segment digit may include retention features and/or coupling features as described above. Joints 708*a*-708*e* are each similar to the interference joint 108 of FIG. 1A-FIG. 1B. Accordingly, adjacent segments 704*a*-704*f* and the corresponding joints 708*a*-708*e* disposed between the adjacent segments are structurally and functionally similar to digit 102, i.e., each pair of adjacent segments can be transitioned from a first state, through an interference state, and into a second state by bending about the respective joint with the joint producing a snap and/or pop as the segments transition between states. With this in mind, FIG. 7A shows digit 702 with each pair of adjacent segments and their respective joints in the first state (longitudinally aligned state), whereas FIG. 7B shows digit 702 with each pair of adjacent segments and their respective joints in the second state.

As shown in FIG. 7B, all the joints 708*a*-708*e* are configured to bend in a same direction, e.g., such that all the segments 704*a*-704*f* can bend about the respective joints in a common direction, forming a crude circle. In some embodiments, one or more of the joints 708*a*-708*e* are configured to bend in a different direction relative to one or more other joints 708*a*-708*e*, e.g., such that the segments 704*a*-704*f* can form a "zig-zag" or similar shape. In some embodiments, one or more of the joints 708*a*-708*e* are configured to bend in both directions (e.g., using a bi-directional interference joint as shown in FIG. 3A-FIG. 3C).

Notably, the segments 704*a*-704*f* are stylized to resemble a fish in the embodiment of FIG. 7A and FIG. 7B, complete with a head and a tail. This demonstrates the general possibility that some segments of a digit may differ from others. Of course, the segments may be shaped in any manner. To this end, in some embodiments, one or more of the elongate digits include a flat or land suitable for applying decals, product information, adornments, or other ornamentation.

Digits of the present disclosure may be coupled together into a digit-based assembly.

FIG. 8A-FIG. 8F show one such digit-based assembly 800 in various configurations. The assembly 800 includes a plurality of digits 802*a*-802*f* coupled together in a closed loop. Each of digits 802*a*-802*f* is the same as digit 102 of FIG. 1A-FIG. 1B except the tab-style coupling features 140, 142 of the digit 102 are substituted in FIG. 8A by direct connections between adjacent digits. Thus, each of the digits 802*a*-802*f* includes an interference joint coupling the segments thereof. Each of digits 802*a*-802*f* is substantially the same; however, in other embodiments, digits of an assembly may vary.

Figure 8A:
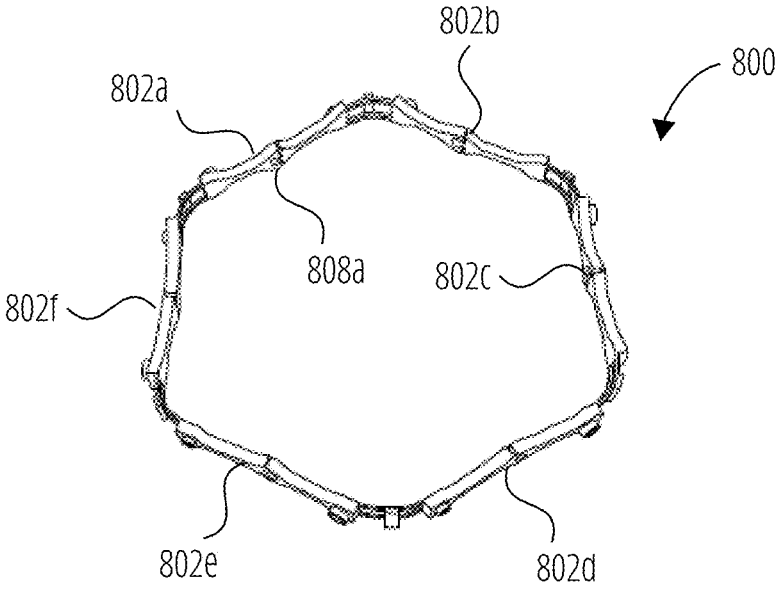
FIG. 8A-FIG. 8F show an assembly of digits according to an embodiment of the present disclosure in various configurations.

FIG. 8A illustrates a first configuration of assembly 800 in which each digit 802*a*-802*f* is oriented to fold inwardly. For purposes of this disclosure, a digit incorporated into a closed structure or assembly is said to fold "inwardly" when, after folding, the joint of the digit is generally directed toward the centroid of the closed structure. Similarly, a digit in a closed structure is said to fold "outwardly" when, after folding, the joint of the digit is generally directed away from the centroid of the closed structure. For example, referring still to FIG. 8A, when digit 802*a* is in the second state and/or fully folded, its joint 808*a* will be disposed radially inward from its retention features toward a centroid of assembly 800.

Figure 8B:
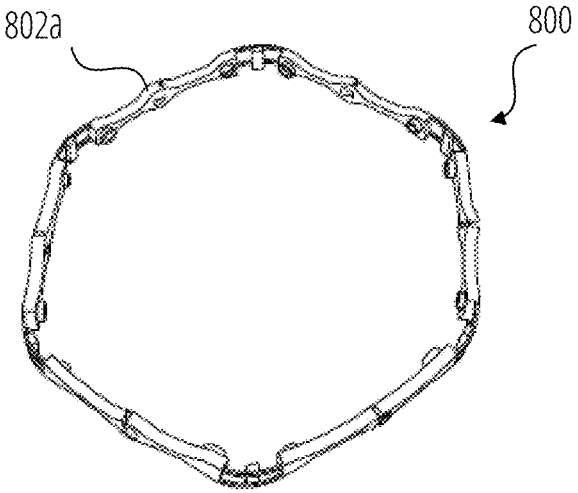

In contrast, FIG. 8B illustrates a second configuration of assembly 800 in which each digit 802*a*-802*f* is oriented to fold outwardly. For example, when digit 802*a* is in the second state and/or fully folded in the configuration shown in FIG. 8B, joint 808*a* of digit 802*a* will be disposed radially outward of its retention features, i.e., away from a centroid of assembly 800. Stated differently, FIG. 8A and FIG. 8B illustrate inversions of assembly 800. Inverting assembly 800 between the configuration of FIG. 8A and FIG. 8B may include twisting or rolling digits 802*a*-802*f* about a loop axis into the desired configuration. This inversion property is enabled by the range of motion of the joints of each digit and optionally a pliable material (e.g., TPU) from which the digits are formed.

Figure 8C:
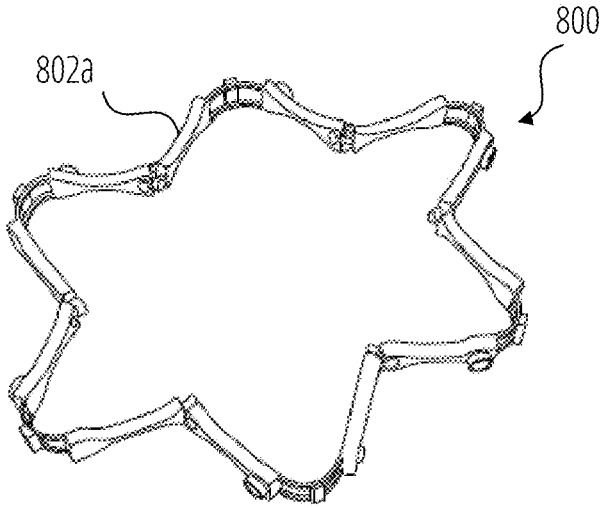

FIG. 8C illustrates a variation of the inwardly folding configuration of assembly 800 shown in FIG. 8A in which each digit 802*a*-802*f* is in the second state, albeit not completely folded such that the retention features of each digit engage.

Figure 8D:
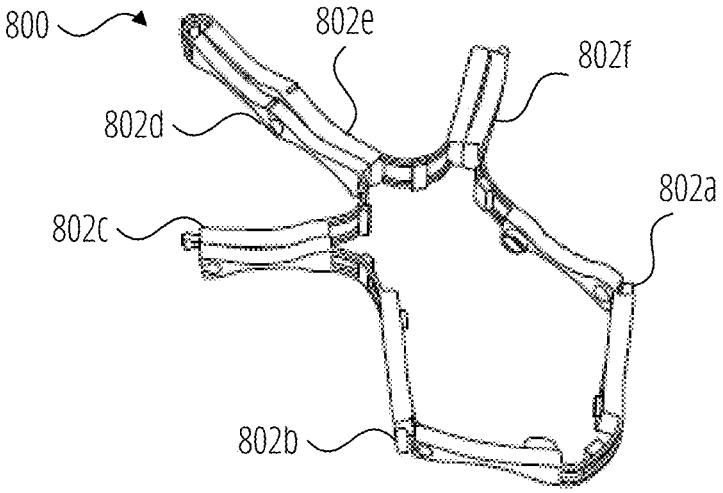

FIG. 8D illustrates a variation of the outwardly folding configuration of the assembly 800 in which digits 802*a*-802*f* are in various configurations. Digits 802*a*, 802*b* are in the second state but not fully folded. Digits 802*c*, 802*f* are in the fully folded configuration (i.e., with their respective retention features engaged). Finally, digit 802*d* is coupled to digit 802*e* by engaging the retention features of both digits (the retention features of digits 802*d*, 802*e* are obstructed due to the coupling).

Figure 8E:
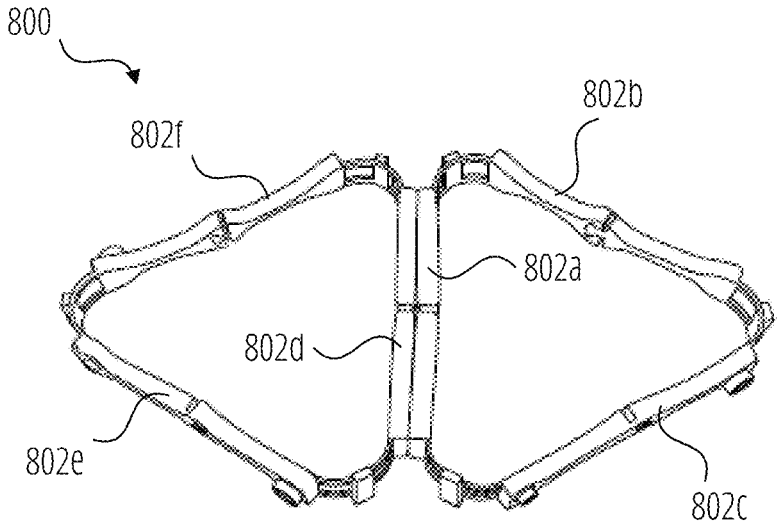

FIG. 8E illustrates another alternative configuration of assembly 800. As discussed above in the context of digit 102, joints of digits according to this disclosure may include interlocking structures, such as socket 116 and protrusion 118. In at least certain implementations, such interlocking structures may also facilitate coupling of digits to each other. For example, when each of a pair of digits is in a fully folded configuration, the mating structures of the joints of each digit may be exposed and coupled together. (e.g., referring to FIG. 1A, socket 116 of the first digit may be inserted into protrusion 118 of the second digit and vice versa).

FIG. 8E illustrates a first example of such coupling in which each digit 802*a* and digit 802*d* are in a fully folded configuration and coupled together by their respective joint structures. More specifically, coupling of digit 802*a* with digit 802*d* results from a joint protrusion of digit 802*a* being inserted into a joint socket of digit 802*d* and a joint socket of digit 802*a* receiving a joint protrusion of digit 802*d*.

Figure 8F:
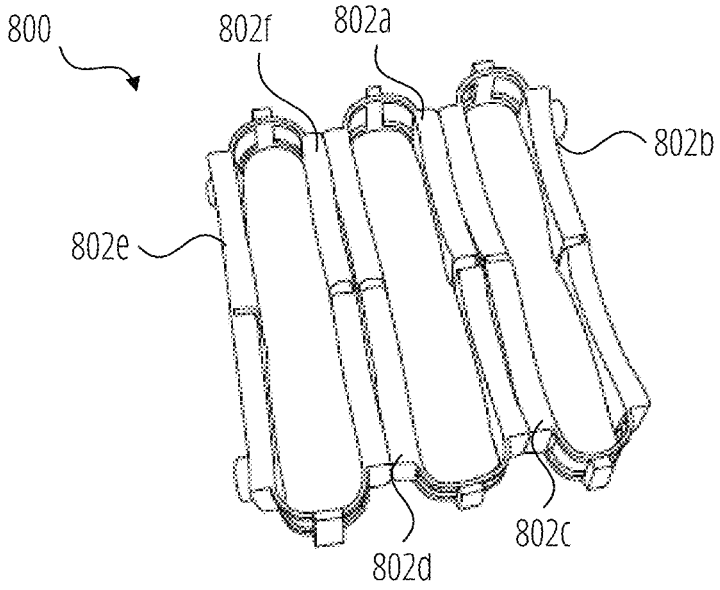

FIG. 8F is a further illustration of the concept of FIG. 8E, wherein digit 802*a* is paired with digit 802*c* and digit 802*d* is paired with digit 802*f*.

Hubs and Other Building Elements

The foregoing implementations of this disclosure included digits and assemblies of digits. In other implementations, digits may be attached to, integrated with, or otherwise coupled to non-digit structures. Such structures include "hubs," which are described below. A given hub may have any suitable size, shape, and appearance and may be attached to or selectively coupled to one or more digits. In certain implementations, hubs and digits may be selectively coupled to each other and constitute a building set (at least one digit and hub) that can be built into a range of structures that can be readily assembled and disassembled. In other implementations, hubs and digits may be permanently fixed to each other. In either case, once a digit is attached to one or more hubs, the digit may be transitioned between states to dynamically change and reconfigure the resulting structure.

Figure 9A:
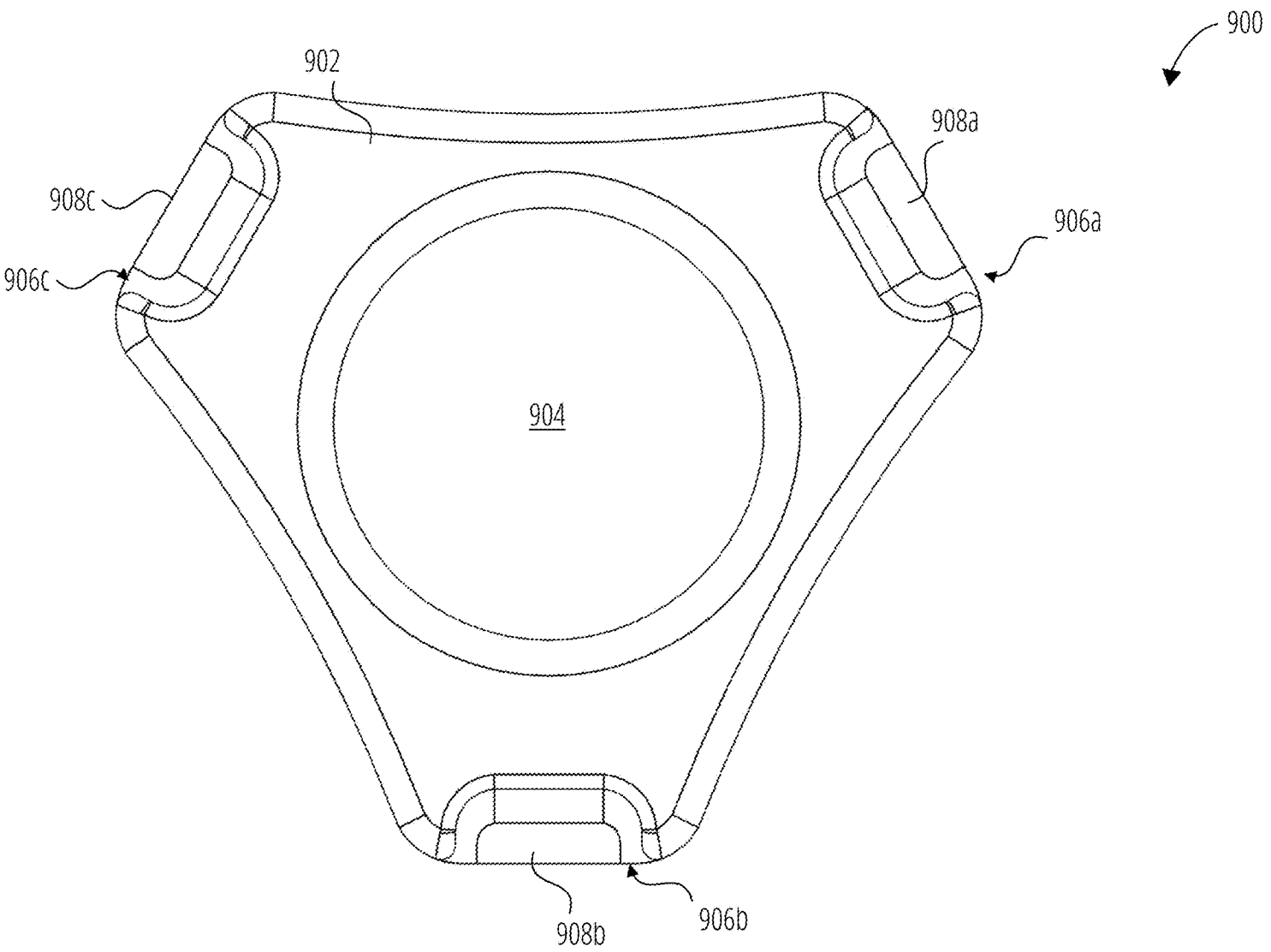
FIG. 9A-FIG. 9C show various views of a hub according to an embodiment of the present disclosure.
Figure 9D:
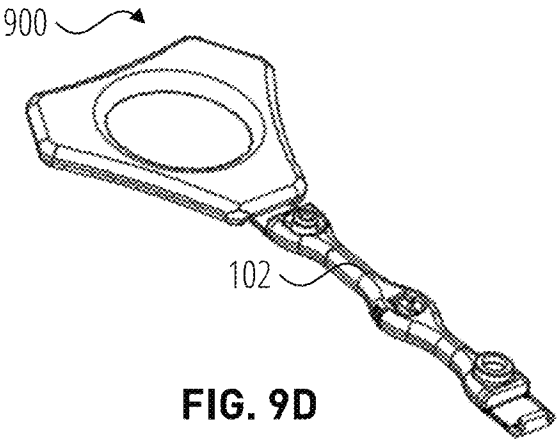
FIG. 9D shows an assembly of a hub and a digit according to an embodiment of the present disclosure.
Figure 9C:
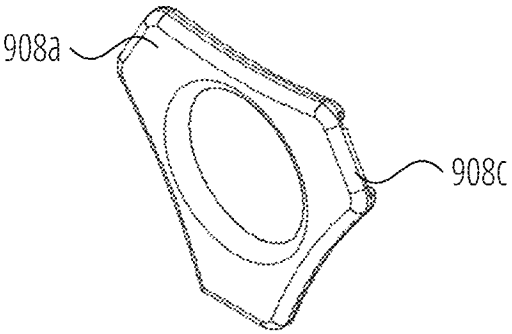
Figure 9B:
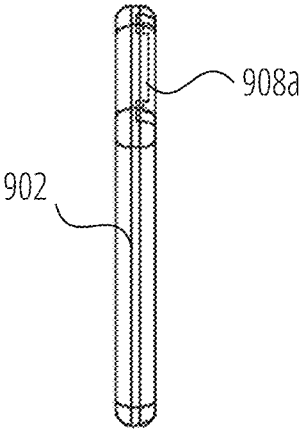

FIG. 9A-FIG. 9D illustrate one representative hub 900 according to this disclosure. In particular, FIG. 9A-FIG. 9C illustrate various views of hub 900, whereas FIG. 9D illustrates a perspective view of a hub 900 including hub 900 and digit 102.

Hub 900 includes a body 902 having a substantially triangular, flat shape defining an optional cutout 904. Body 902 further includes vertexes 906*a*-906*c* defining coupling features formed as slots 908*a*-908*c*. The coupling features of any given hub are configured to mechanically couple with coupling features of one or more digits. In the illustrated embodiment shown, the coupling features of hub 900 are formed as slots and thus configured for coupling with tab-type coupling features (e.g., as shown with respect to coupling features 140, 142 of digit 102 of FIG. 1A-FIG. 1B). However, other hubs may include coupling features configured as sockets, ball joints, tabs, and other interconnecting structures configured to couple with complementary coupling features of digits.

The triangular shape of hub 900 is representative, not limiting. Other hubs of the present disclosure have different shapes, which may include polygonal shapes (e.g., square, pentagonal, hexagonal, etc.). Advantageously, a greater number of vertexes increases how many different assemblies can be assembled with digits.

The cutout 904 is optional but facilitates the manipulation of assemblies into different states. In particular, cutouts facilitate pulling a digits from a second state (e.g., a state where a plurality of digits are substantially parallel, as shown in FIG. 17C) to a first state (e.g., a longitudinally aligned configuration, as shown in FIG. 17B). Other hubs do not include such a cutout, advantageously providing a flat or land suitable for application of decals, product information, adornments, or other ornamentation.

Referring to FIG. 9D, the coupling structure of hub 900 can be coupled to corresponding coupling structure of one or more digits, e.g., digit 102. In some embodiments, the digit 102 may be affixed to the hub 900 during manufacturing. For example, the coupling feature of digit 102 may be adhered, welded, pinned, or otherwise attached to the coupling feature of hub 900. In some embodiments, body 902 may include multiple pieces (e.g., body 902 may have a clamshell or multi-layered laminate) such that the coupling feature of digit 102 is retained within (e.g., sandwiched between) two or more parts of the hub 900. In still other implementations, digit 102 and hub 900 are integrally formed, e.g., injection molded, 3D printed, or otherwise manufactured as a unitary piece.

Figures 12B, 13:
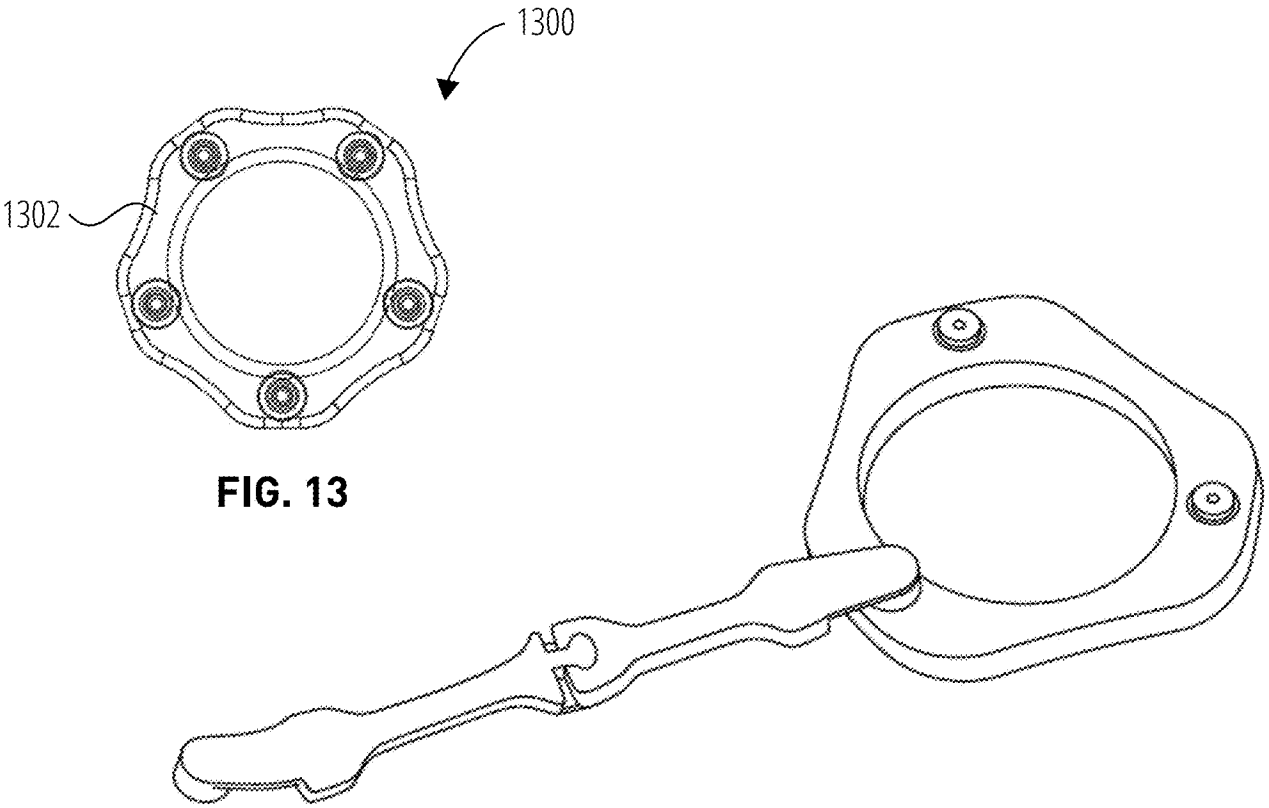
FIG. 12B shows an assembly of the hub and the digit of FIG. 12A.
FIG. 13 shows still another hub according to an embodiment of the present disclosure.
Figure 15C:
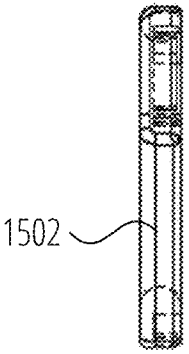
FIG. 15A-FIG. 15E show various views of a hub according to still another embodiment of the present disclosure.
Figure 15B:
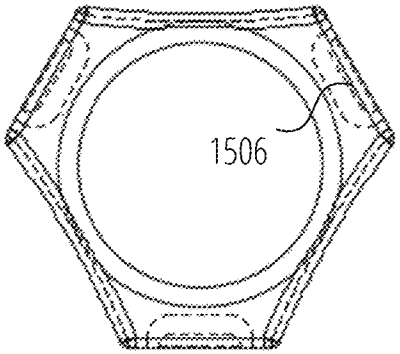
Figure 15E:
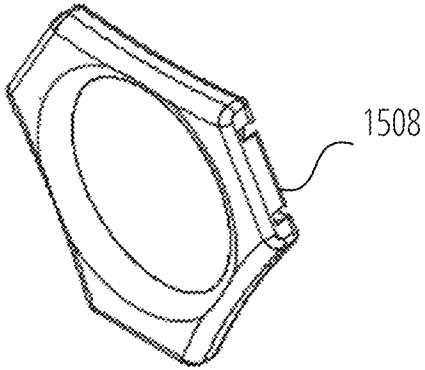
Figure 15A:
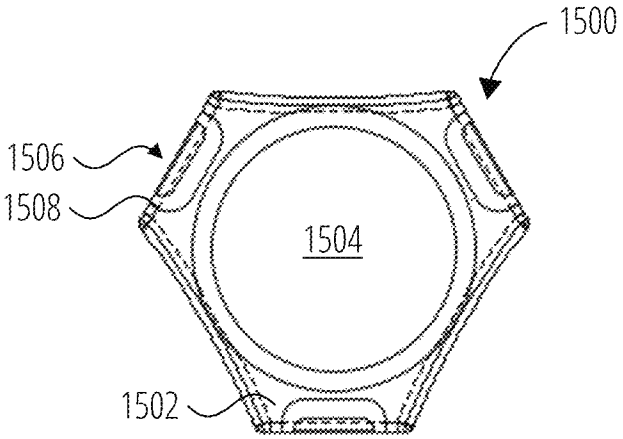
Figure 15D:
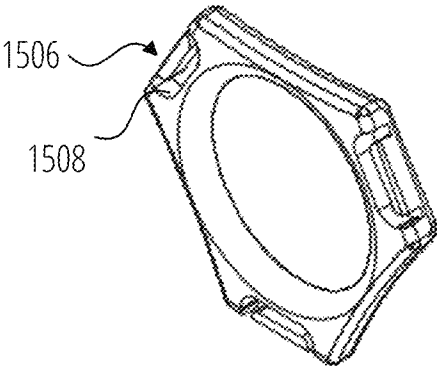
Figure 16A:
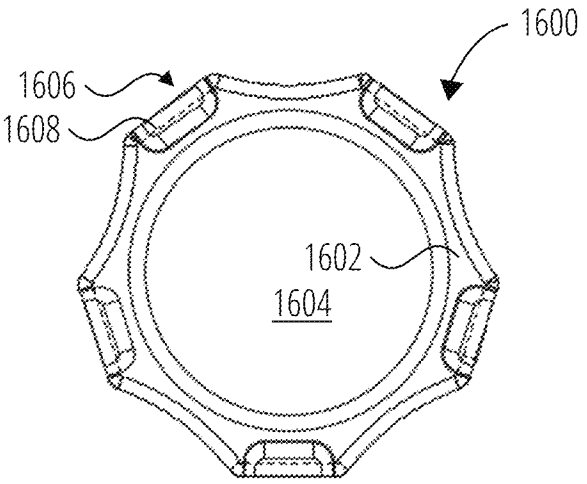
FIG. 16A-FIG. 16E show various views of a hub according to still another embodiment of the present disclosure.
Figure 16B:
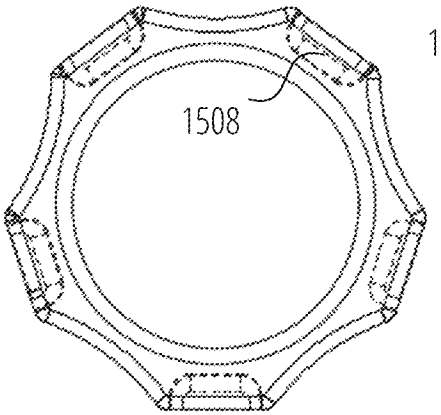
Figure 16C:
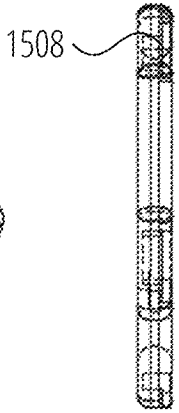
Figure 16D:
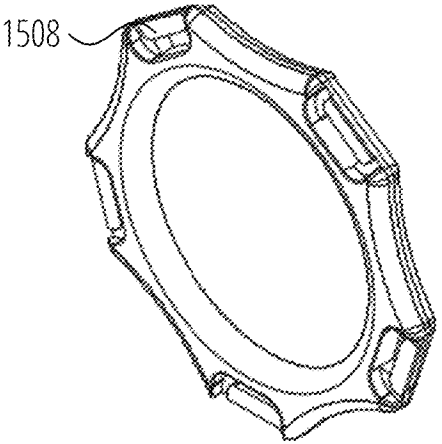
Figure 16E:
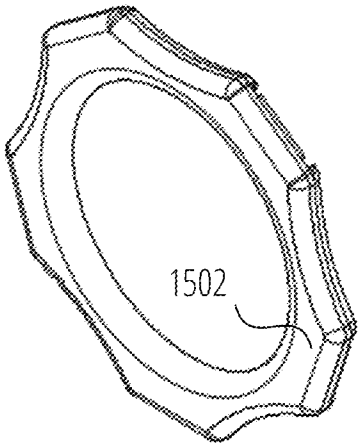

In other implementations, hubs and digits may be selectively coupled together in that a given hub may include a feature adapted to couple with a corresponding feature of a digit. FIG. 12B and FIG. 10B, for example, illustrate implementations in which a hub is selectively coupled to a digit, which is discussed above in the context of FIG. 2A-FIG. 2D.

FIG. 10A and FIG. 10B illustrate an alternative coupling approach utilizing a ball-and-socket connection. Referring to FIG. 10A, an assembly or building set includes a hub 1000 and a digit 1002. Hub 1000 includes a body around the perimeter of which are disposed multiple sockets 1008*a*-1008*c* (one at each vertex), wherein each socket is shaped to receive a corresponding ball protrusion coupling feature 1040 of the digit 1002 (as described previously with respect to FIG. 2A). FIG. 10B shows the digit 1002 coupled with the hub 1000. Advantageously, the ball-and-socket coupling mechanism enables greater range of relative motion between the hub 1000 and digit 1002 as compared to press fit-type coupling features.

The foregoing examples of hub and digit assemblies are intended as representative examples. For example, while FIG. 12B and FIG. 10B illustrate selective coupling between hubs and digits using press fit-style coupling features and ball-and-socket coupling features, respectively, implementations of this disclosure may alternatively rely on magnets, reusable adhesive surfaces, hook-and-loop structures, interlocking structures (e.g., mortise and tenon or dovetail-style joints), or any other suitable coupling means.

Hubs according to this disclosure are also not limited to the particular shapes and structures illustrated in the previously discussed figures. For example, while FIG. 9A-FIG. 9C, FIG. 12A-FIG. 12B illustrate flat triangular and pentagonal hubs, hubs of other embodiments may take the form of any regular (e.g., polygonal) or irregular shape.

As still another example, hubs of the present disclosure need not be substantially flat. Rather, hubs may have a space-filling construction resembling a parallelepiped (E.g., cube), pyramids, tetrahedrons, octahedra, dodecahedra, or other space-filling regular or irregular shape. Such space-filling hubs may have substantially solid construction or may be formed of a lattice of frame elements providing a skeletal hub structure.

While each of the hubs in FIG. 9A-FIG. 10B include a circular cutout, such a cutout may be any suitable shape or omitted altogether, e.g., to provide a flat surface for applying decals, product information, adornments, or other ornamentation.

Hubs may also be configured to couple with one another using any suitable coupling mechanism, including structures resembling any of the coupling features described herein. Stated more generally, hubs according to this disclosure may be readily adapted into any suitable shape provided that they are configured to couple with one or more digits. Moreover, while the foregoing examples illustrate hubs with coupling locations that are distributed regularly about a surface or outer periphery of the hub, hubs may be readily adapted to include any number of coupling locations disposed at any location on the hub.

Figure 11:
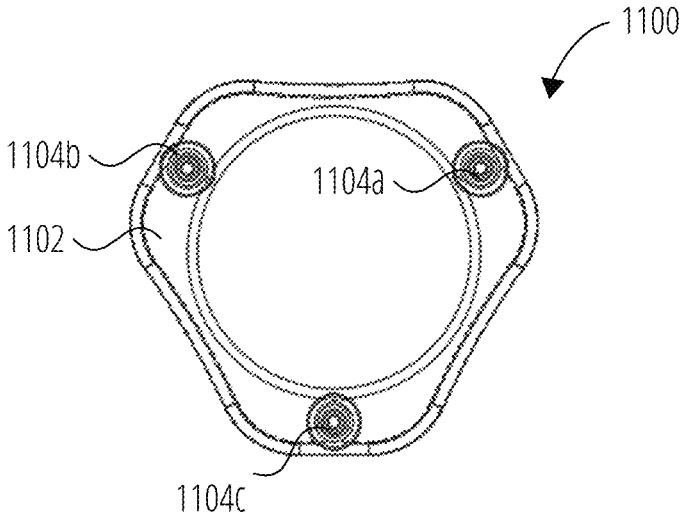
FIG. 11 shows another hub according to an embodiment of the present disclosure.

FIG. 11 shows another hub 1100 which is similar to hub 900, and includes a body 1102 having a substantially triangular, flat shape. Body 1102 further includes three vertexes defining coupling features 1104*a*-1104*c*.

Figure 12A:
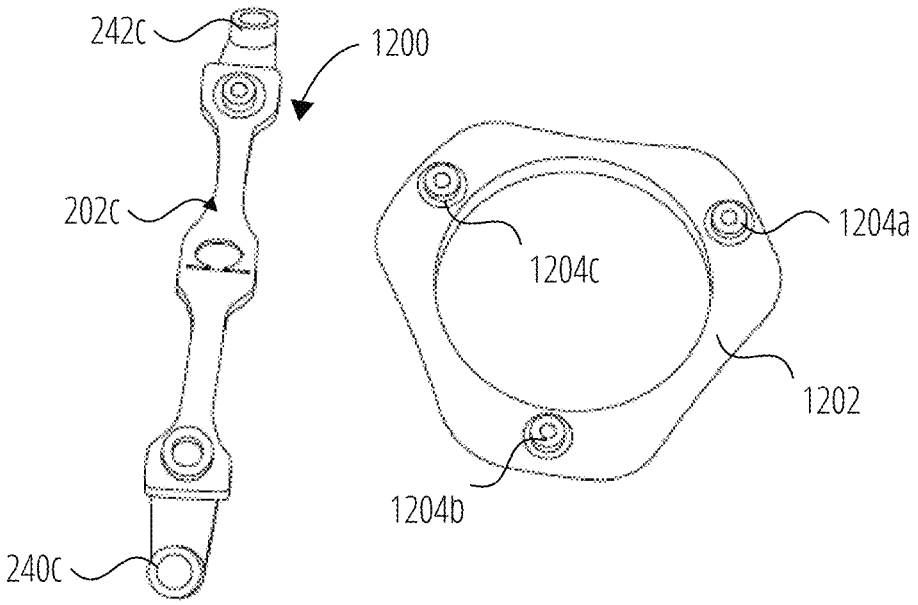
FIG. 12A shows a hub and a digit according to an embodiment of the present disclosure.

FIG. 12A provides another representative hub 1200 having different coupling features than hub 900. In particular, hub 1200 includes a body 1202 having multiple coupling features 1204*a*-1204*c* shaped to mate with coupling features of a digit, e.g., coupling features 240*c*, 242*c* of digit 202*c* (as shown in FIG. 12B).

FIG. 13 illustrates an alternative hub 1300 including a pentagonal body 1302 with five vertexes upon each of which coupling features are respectively formed.

FIG. 14A-FIG. 14E illustrate an alternative hub 1400 according to this disclosure. Hub 1400 includes a body 1402 having a substantially square, flat shape that defines an optional cutout 1404. Body 1402 further includes truncated vertices (e.g., truncated vertex 1406) having a coupling feature 1408, e.g., a groove or other coupling feature configured to attach to or retain coupling features of digits according to this disclosure.

FIG. 15A-FIG. 15E illustrate another alternative hub 1500 according to this disclosure. Hub 1500 includes a body 1502 having a substantially triangular, flat shape that defines an optional cutout 1504. Body 1502 further includes truncated vertices (e.g., truncated vertex 1506) having respective coupling features 1508, e.g., a groove or other coupling feature configured to attach to or retain coupling features of digits according to this disclosure.

FIG. 16A-FIG. 16E illustrate another alternative hub 1600 according to this disclosure. Hub 1600 includes a body 1602 having a substantially pentagonal, flat shape that defines an optional cutout 1604. Body 1602 further includes truncated vertices (e.g., truncated vertex 1606) having coupling features 1608, e.g., a groove or other coupling feature configured to attach to or retain coupling features of digits according to this disclosure.

Toy Assemblies

The foregoing concepts for hubs and digits can be incorporated and modified into a wide range of structures and assemblies, including as toys. This section provides various example designs for hub and digit structures and highlights various features of the example designs. The example implementations are intended to be non-limiting and illustrative of the concepts discussed herein. Concepts included in any of the example implementations may be combined or modified to arrive at designs not specifically illustrated or discussed herein.

The assemblies described below can generally be characterized as "open" or "closed." Open assemblies or open configurations generally comprise at least one digit which is uncoupled from a hub, including two-dimensional lattices. Closed assemblies or closed configurations are generally characterized by a three-dimensional shape (e.g., a cube, tetrahedron, or icosahedron) and/or substantially all of the digits are coupled to a hub.

The closed assemblies or closed configurations can be further characterized as "stable" or "unstable." In stable configurations, the digits are stabilized in position by the respective interference joints or retention features. For example, stable configurations include closed configurations in which each digit is stabilized in the longitudinally aligned state by the respective interference joint. As another example, stable configurations include closed configurations in which each digit is stabilized in the parallel segments state by the respective retention features. Stable configurations may be characterized by rigidity and load bearing capability without significant deformation.

By comparison, in unstable configurations, one or more of the digits freely flex or bend within a range of motion without significant interference from the interference joint (e.g., the interference members). For example, unstable configurations include closed configurations in which one or more of the digits is in a partial flexion state wherein the interference members do not interfere (i.e., are released), e.g., as shown in FIG. 2C. Unstable configurations may be characterized by elasticity, springiness, or a generally inability to bear a load without significantly deforming. Unstable configurations have greater elasticity that stable configurations of the same assembly.

Any of the closed assemblies described herein have an inversion property whereby the assembly can be inverted into an inverted state (i.e., turned inside out into an inside out state) without disconnecting or uncoupling any of the digits from the hubs. This property is enabled by the range of motion of the respective joints. Optionally, the inversion property is facilitated by a pliable material (e.g., TPU) from which the digits are at least partially formed.

The following assemblies each have multiple independent degrees of freedom. Restated, any one of the digits may be transitioned between the first state and second state independently of other digits of the assembly.

Figure 17A:
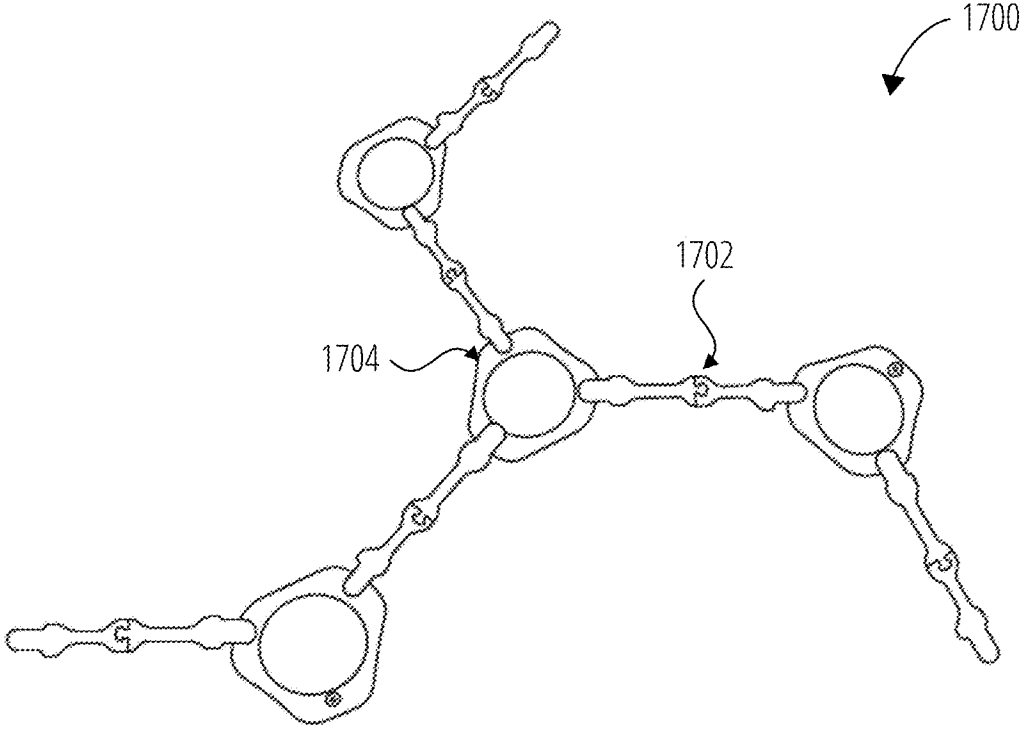
FIG. 17A-FIG. 17C show an assembly of hubs and digits in various configurations according to an embodiment of the present disclosure.
Figure 17B:
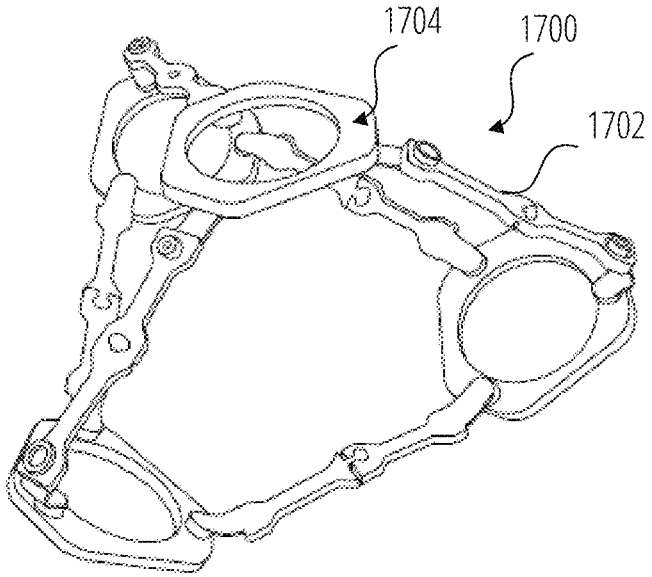
Figure 17C:
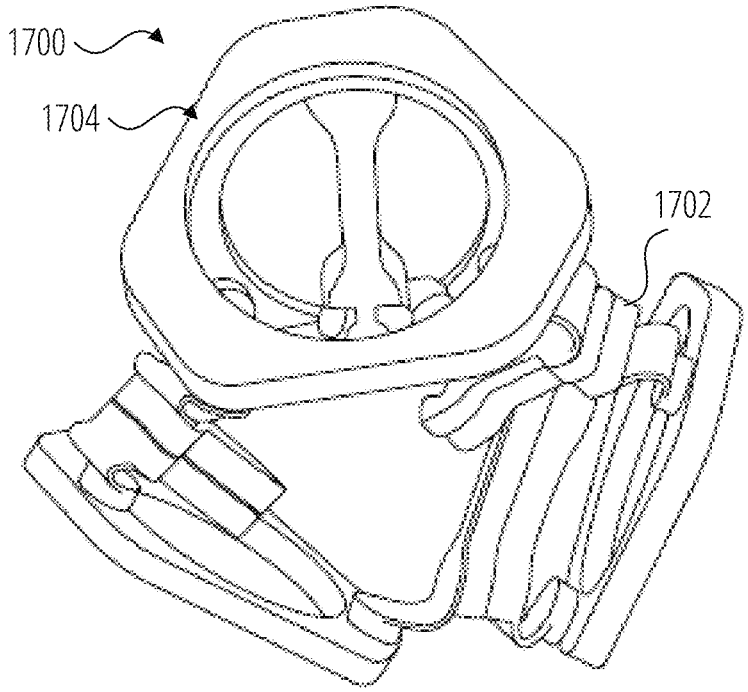

FIG. 17A-FIG. 17C illustrate an assembly 1700 comprising a plurality of digits (e.g., six digits such as digit 1702), each of which is substantially similar to digit 202*a* (discussed above in the context of FIG. 2A-FIG. 2D) and a plurality of hubs (e.g., four hubs such as hub 1704), each of which is substantially similar to hub 1200 (discussed above in the context of FIG. 12A).

FIG. 17A illustrates assembly 1700 as an open assembly in a partially constructed configuration in which the digits and hubs are not fully connected and, as a result, form a flat lattice, i.e., a substantially flat open structure or planar assembly of at least one hub coupled to at least one digit. Specifically, in FIG. 17A, one coupling feature of each digit is coupled with one hub, but at least one other coupling feature of each digit is uncoupled to any hub or other digit. Further, the assembly 1700 in FIG. 17A is substantially flat and planar. Lattices are useful assemblies for packaging purposes, and any assembly of at least one digit and at least one hub may be claimed as a lattice. Additionally, lattices reduce the number of points that need to be connected in order for a user to realize a complete assembly of building elements. For example, the open structure lattice shown in FIG. 17A needs only be connected at three locations to realize the closed structure assemblies 1700 of FIG. 17B and FIG. 17C.

FIG. 17B illustrates the assembly 1700 in a stable closed assembly or a closed configuration in which the digits and hubs are fully connected, i.e., each coupling feature of each digit is coupled with a coupling feature of a hub. In the configuration of FIG. 17B, each of the digits is stable in a first state (e.g., longitudinally aligned state). Assembly 1700 forms a generally tetrahedral shape in this configuration. As will be appreciated from the following description of other embodiments, the assembly 1700 has multiple degrees of freedom.

Referring to FIG. 17C, any or all of the digits may be bent/folded into an alternative closed configuration up to and including being fully folded into a second state in which the segments of each digit are parallel to each other). FIG. 17C illustrates the assembly 1700 in another stable closed configuration wherein all of the digits are in the second state or fully folded state. In the second state or fully folded state, the retention features of at least one digit may be mated with other retention features thereof.

Both closed assemblies of FIG. 17B and FIG. 17C are stabilized states. For example, the closed configuration of FIG. 17B is stable because each of the digits is in an extension state. The closed configuration of FIG. 17C is stable because each of the digits is in a full flexion state (parallel segments state).

A user may assemble the assembly 1700 from the lattice of FIG. 17A into a fully connected configuration and may thereafter modulate the assembly 1700 between a first configuration (FIG. 17B) and a second configuration (FIG. 17C), and in numerous intermediate states. When any of the digits is in the first state (as shown in FIG. 17B), the user can push on any of the hubs to move the digit(s) into the second state. In any embodiment, the digits may include interference joints as described above. In such embodiments, manipulating the digit(s) out of the first state causes the interference joint to produce an entertaining "pop" or "snap" audible and tactile feedback.

When any of the digits is in the second state (as shown in FIG. 17C), the user can pull on any of the hubs to extend one or more digits into the axially aligned first state. Manipulating the digit(s) out of the second state may also produce an audible and/or tactile "pop" or "snap" feedback due to the release of the retention features.

Thus, the assembly 1700 comprises a plurality of digits which are coupled or couplable with a plurality of hubs. The assembly 1700 is reconfigurable between an open configuration and at least two different closed configurations. Assembly 1700 is reconfigurable between a stable closed configuration and at least one unstable closed configuration.

The remaining structures discussed in this section are illustrated as having permanently coupled digits and hubs (e.g., welded together). Notably, each such structure may alternatively be constructed from suitable digits and hubs configured to be selectively coupled together, e.g., as in a building set.

Figure 18B:
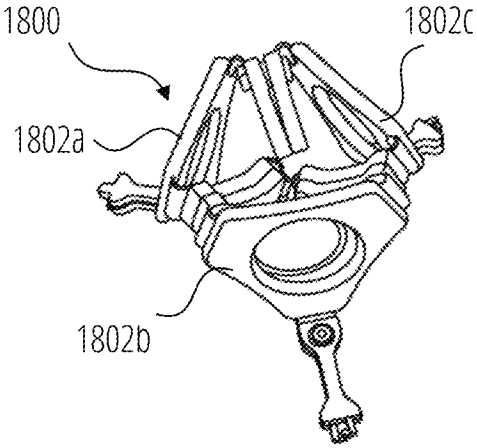
FIG. 18A-FIG. 18C show an assembly of hubs and digits in various configurations according to another embodiment of the present disclosure.
Figure 18A:
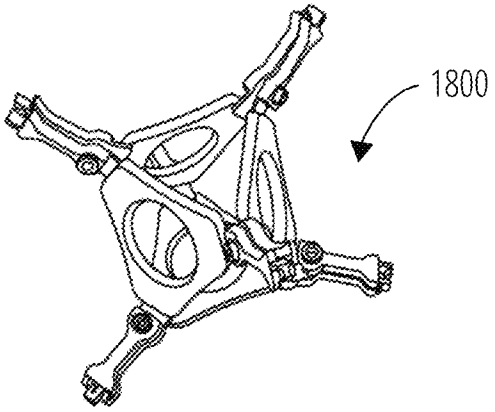
Figure 18C:
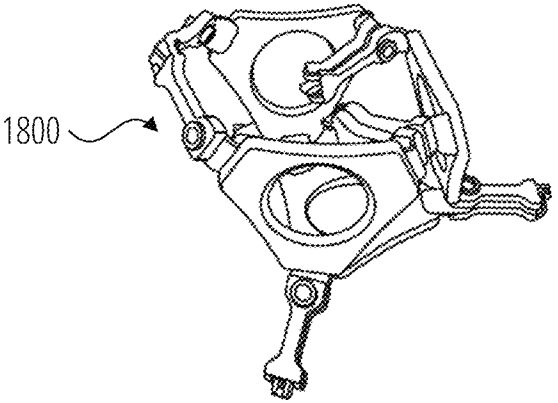

FIG. 18A-FIG. 18C illustrate an assembly 1800 comprising a plurality of digits (six digits in this embodiment), each of which is substantially similar to digit 202*d* (discussed above in the context of FIG. 2A), and a plurality of hubs (in this embodiment, four hubs), each of which is substantially similar to hub 900 (discussed above in the context of FIG. 9A-FIG. 9C). As discussed above in the context of FIG. 2A, digit 202*d* includes a bi-directional interference joint and is therefore configured to transition between and retained in two opposite, fully folded configurations.

FIG. 18A illustrates assembly 1800 in a stable closed configuration with each digit folded outwardly into the second state (parallel segments state). FIG. 18B illustrates assembly 1800 in another stable closed configuration with some digits folded inwardly into the second state and other digits folded outwardly relative to the centroid of the assembly. FIG. 18C illustrates assembly 1800 in an unstable configuration with some digits fully and partially folded outwardly and other digits folded inwardly.

The assembly 1800 is one example of an expandable assembly which includes a plurality of hubs and a first plurality of digits. The plurality of hubs comprises a first hub, a second hub, and a third hub. The first plurality of digits connects the first hub to the second hub and to the third hub. Assembly 1800 has multiple degrees of freedom. For example, relative distances between hubs 1802*a*-1802*c* can be independently varied. For example, assembly 1800 is expandable from a first state (FIG. 18B) to a second state (FIG. 18C), wherein the first hub 1802*a* is spaced apart from the second hub 1802*b* and the third hub 1802*c* by a greater distance in the second state than the first state, wherein the second hub 1802*b* and the third hub 1802*c* are spaced apart by a same distance in both the first state and the second state.

Thus, the assembly 1800 comprises a plurality of digits which are coupled or couplable with a plurality of hubs. The assembly 1800 is reconfigurable between at least two stable closed configurations and at least one unstable closed configuration.

Figure 19B:
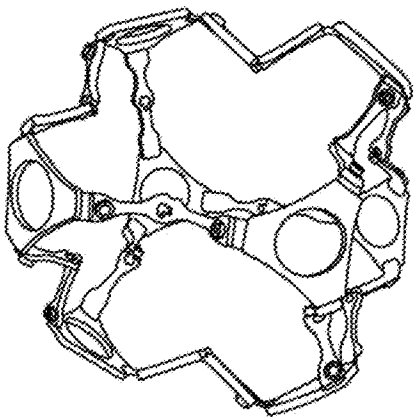
FIG. 19A-FIG. 19D show an assembly of hubs and digits in various configurations according to still another embodiment of the present disclosure.
Figure 19D:
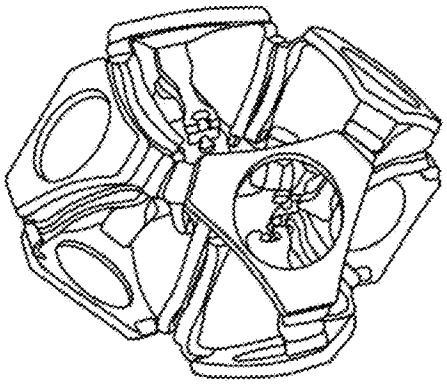
Figure 19A:
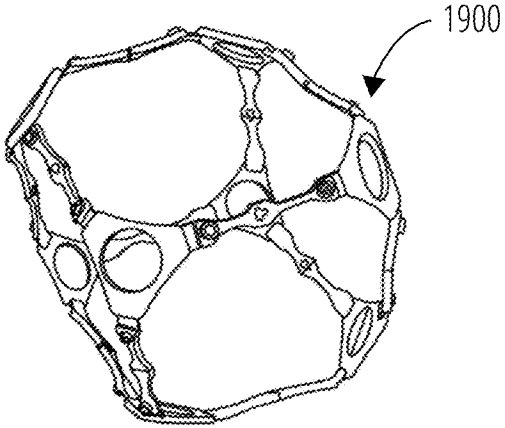
Figure 19C:
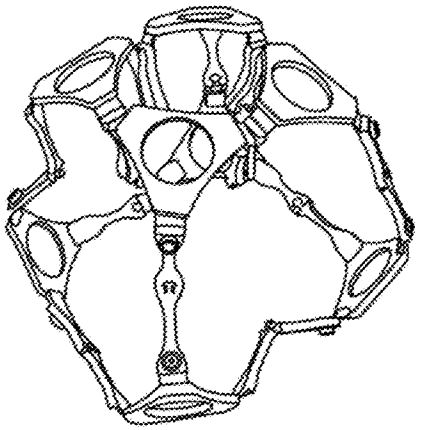

FIG. 19A-FIG. 19D illustrate an assembly 1900 comprising a plurality of digits (here, twelve digits), each of which is substantially similar to digit 102 (discussed above in the context of FIG. 1A-FIG. 1B), and a plurality of hubs (here, eight hubs), each of which is substantially similar to hub 900 of FIG. 9A. When each digit of assembly 1900 is in the first state, assembly 1900 forms the stable closed cubic shape shown in FIG. 19A. FIG. 19B-FIG. 19D illustrate assembly 1900 with digits in various states. Specifically, FIG. 19B illustrates assembly 1900 in an unstable closed configuration with all digits in a partially folded state. FIG. 19C illustrates assembly 1900 in another unstable closed configuration with some digits in the first state (longitudinally aligned state), some digits in a partially folded state, and some digits in the second state (fully folded state). FIG. 19D illustrates assembly 1900 in another stable closed configuration with all digits fully folded inwardly and stabilized in the second state (parallel segments state) by retention features.

Thus, the assembly 1900 comprises a plurality of digits which are coupled or couplable with a plurality of hubs. The assembly 1900 is reconfigurable between a plurality of stable closed configurations and a plurality of unstable closed configurations.

Figure 20B:
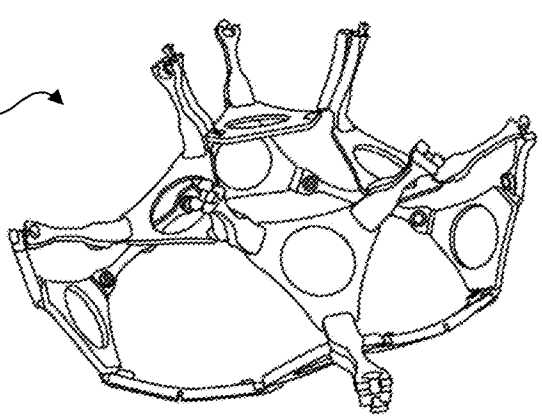
FIG. 20A-FIG. 20C show an assembly of hubs and digits in various configurations according to still another embodiment of the present disclosure.
Figure 20A:
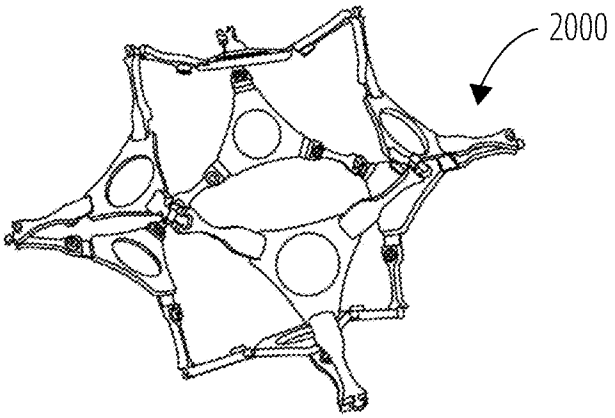
Figure 20C:
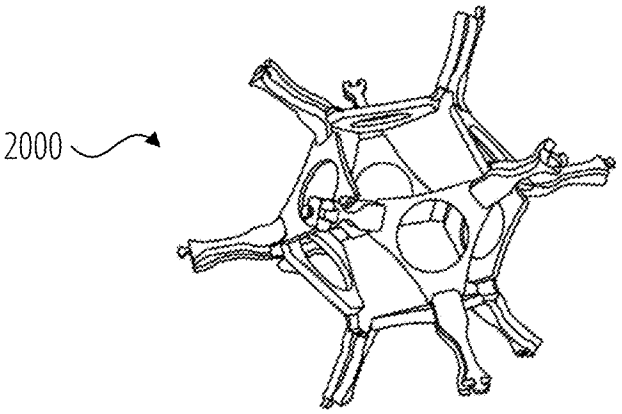

FIG. 20A-FIG. 20C illustrate an assembly 2000, which is substantially similar to assembly 1900, except that the each digit has been inverted such that each digit fold outwardly instead of inwardly. Thus, assemblies 1900, 2000 have the inversion property described above with respect to assembly 800, which is enabled by range of motion of the respective joints and the pliable material (e.g., TPU) from which the digits are at least partially formed. In fact, the assembly 1900 can be inverted into the assembly 2000 without disconnecting or uncoupling any of the digits from the hubs. This property is generally true for all closed assemblies described herein.

FIG. 20A illustrates assembly 2000 in an unstable closed configuration with each digit partially folded outwardly. FIG. 20B illustrates assembly 2000 in another unstable closed configuration with some digits fully folded outwardly in the second state (parallel segments state), some digits partially folded outwardly, and some digits in the first state (longitudinally aligned state). FIG. 20C illustrates assembly 2000 in a stable closed configuration with all digits fully folded outwardly and stabilized in the second state (parallel segments state) by retention features. When each digit of assembly 2000 is in the first state (longitudinally aligned state), assembly 2000 has a stable cubic closed configuration similar to that of assembly 1900 in FIG. 19A.

Thus, the assembly 2000 comprises a plurality of digits which are coupled or couplable with a plurality of hubs. The assembly 2000 is reconfigurable between a plurality of unstable closed configurations and a plurality of stable closed configurations.

Figure 21A:
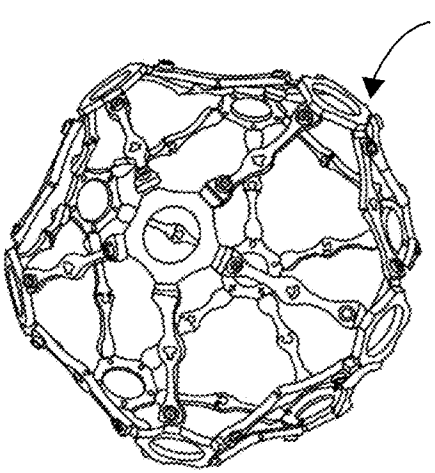
FIG. 21A-FIG. 21E show an assembly of hubs and digits in various configurations according to still another embodiment of the present disclosure.
Figure 21B:
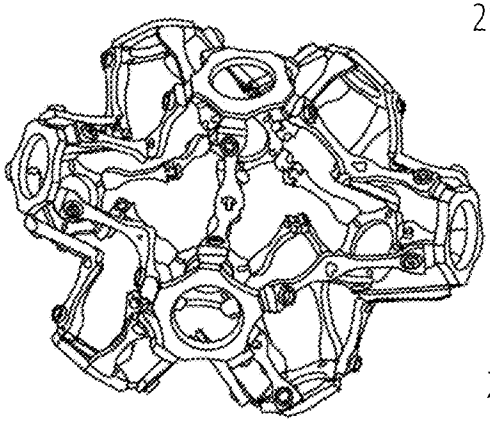
Figure 21C:
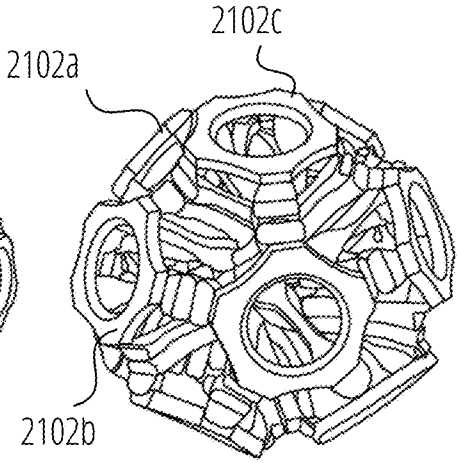
Figure 21D:
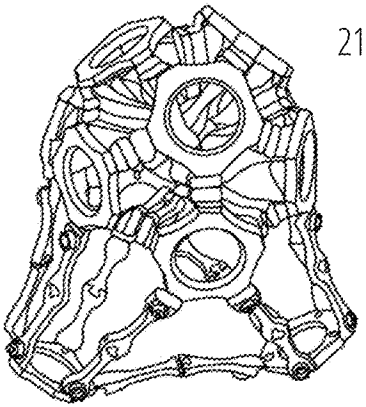
Figure 21E:
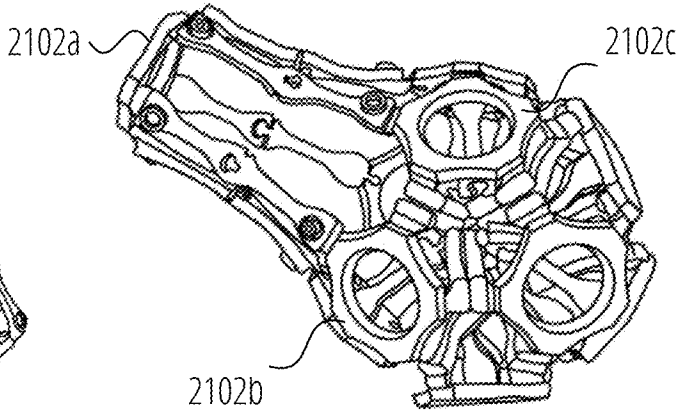

FIG. 21A-FIG. 21E illustrate an assembly 2100 comprising a plurality of digits (here, thirty digits), each of which is substantially similar to digit 102 (discussed above in the context of FIG. 1A), and a plurality of hubs (here, twelve pentagonal hubs), each of which is substantially similar to hub of FIG. 13. As shown in the stable closed configuration of FIG. 21A, when each digit of assembly 2100 is in the first state (longitudinally aligned state), assembly 2100 forms a stable icosahedral shape. FIG. 21B-FIG. 21E illustrate assembly 2100 with digits in various stages of folding. FIG. 21B illustrates assembly 2100 in an unstable closed configuration with all digits in a partially folded state. FIG. 21C illustrates assembly 1900 in a stable closed configuration with all digits fully folded inwardly into a second state (parallel segments state). FIG. 21D illustrates assembly 1900 in another stable closed configuration with a first set of digits fully folded inwardly into a second state and the remainder of digits in the first state (longitudinally aligned state). FIG. 21E illustrates assembly 1900 in still another stable closed configuration with a second set of digits fully folded inwardly into the second state and the remainder of digits in the first state.

As with the previous assemblies, assembly 2100 has multiple degrees of freedom. For example, relative distances between hubs 2102*a*-2102*c* can be independently varied. For example, assembly 2100 is expandable from a first state (FIG. 21C) to a second state (FIG. 21E), wherein the first hub 2102*a* is spaced apart from the second hub 2102*b* and the third hub 2102*c* by a greater distance in the second state than the first state, wherein the second hub 2102*b* and the third hub 2102*c* are spaced apart by a same distance in both the first state and the second state.

Thus, the assembly 2100 comprises a plurality of digits which are coupled or couplable with a plurality of hubs. The assembly 2100 is reconfigurable between a plurality of unstable closed configurations and a plurality of stable closed configurations.

Figure 22A:
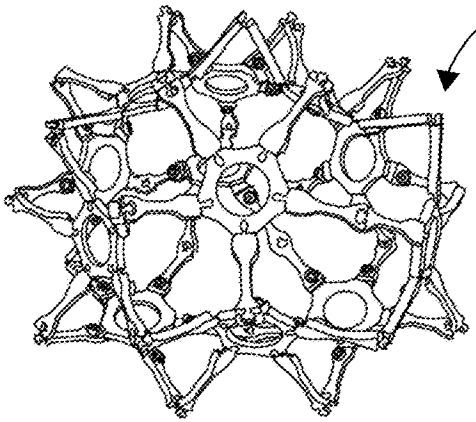
FIG. 22A-FIG. 22C show an assembly of hubs and digits in various configurations according to still another embodiment of the present disclosure.
Figure 22B:
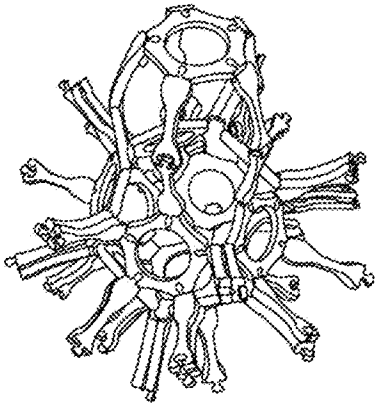
Figure 22C:
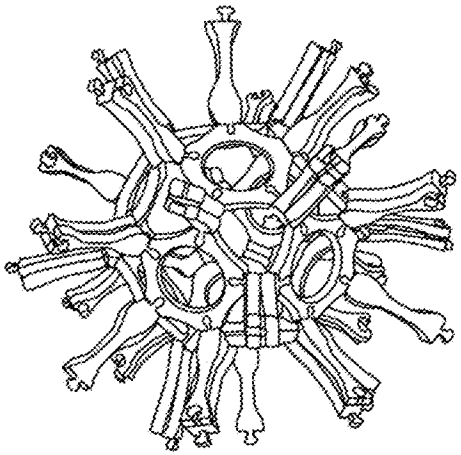

FIG. 22A-FIG. 22C show an assembly 2200 which is substantially similar to assembly 2100 albeit with the direction of each digit inverted such that each digit folds outwardly instead of inwardly. Thus, assemblies 2100, 2200 have the inversion property described above with respect to assemblies 800, 1900, 2000, which is enabled by range of motion of the respective joints and the pliable material (e.g., TPU) from which the digits are at least partially formed. The assembly 2100 can be inverted into the assembly 2200 without disconnecting or uncoupling any of the digits from the hubs.

FIG. 22A illustrates assembly 2200 in an unstable closed configuration with each digit partially folded outwardly. FIG. 22B illustrates assembly 2200 in another unstable closed configuration with some digits fully folded outwardly into the second state (parallel segments state) and some digits partially folded outwardly. FIG. 20C illustrates assembly 2200 in a stable closed configuration with all digits fully folded outwardly into the second state. When each digit of hub 900 is in the first state (longitudinally aligned state), assembly 2200 has an icosahedral structure similar to that of assembly 2100.

Figure 23B:
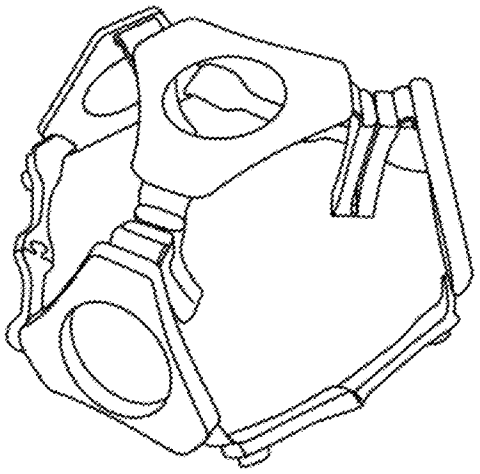
FIG. 23A-FIG. 23C show an assembly of hubs and digits in various configurations according to still another embodiment of the present disclosure.
Figure 23C:
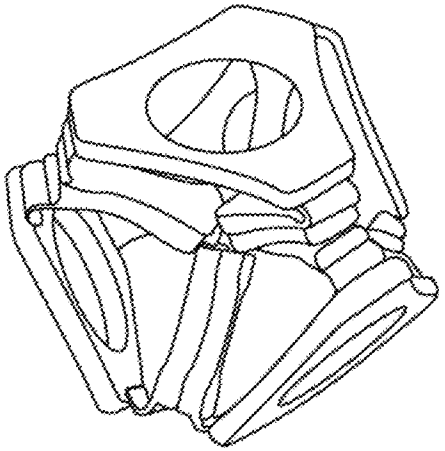
Figure 23A:
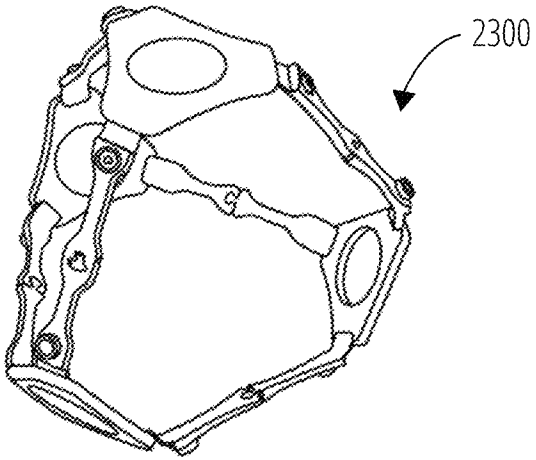

FIG. 23A-FIG. 23C illustrate an assembly 2300 comprising a plurality of digits (here, six digits), each of which is substantially similar to digit 102 (discussed above in the context of FIG. 1A-FIG. 1B), and a plurality of hubs (here, four triangular hubs), each of which is substantially similar to hub 900. Assembly 2300 is substantially similar to assembly 1700 albeit with its digits permanently affixed to the hubs. When each digit of assembly 2300 is in the first state (longitudinally aligned state), assembly 2300 forms a stable closed tetrahedral configuration. FIG. 23B illustrates assembly 2300 in another stable closed configuration with some digits in the first state and some digits in a fully inwardly folded second state. FIG. 23C shows assembly 2300 in another stable closed configuration with all digits folded into the fully inwardly folded second state.

Figure 24B:
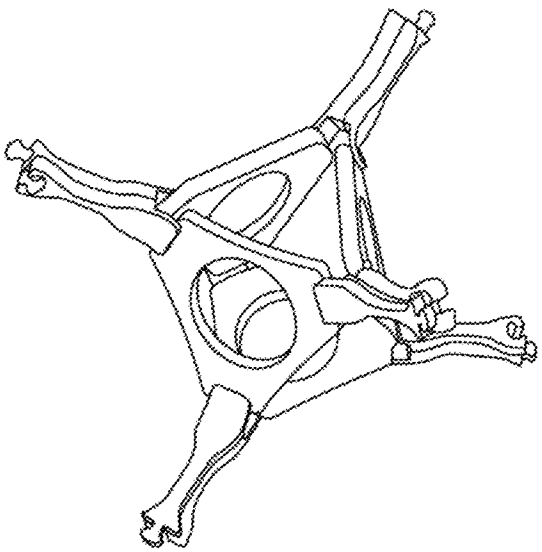
FIG. 24A-FIG. 24B show an assembly of hubs and digits in various configurations according to still another embodiment of the present disclosure.
Figure 24A:
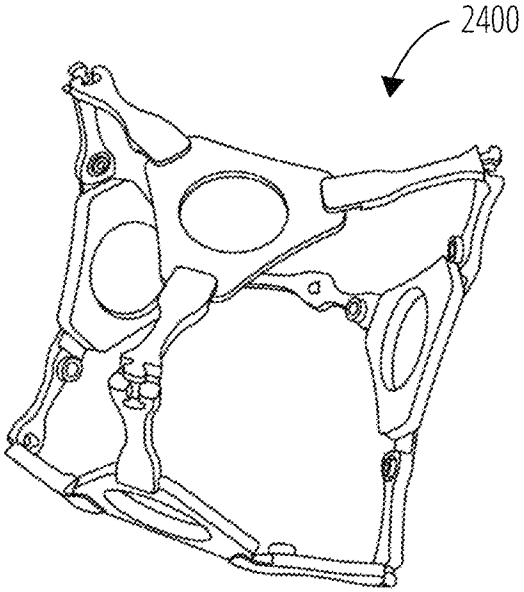

FIG. 24A-FIG. 24B illustrate an assembly 2400, which is substantially similar to assembly 2300 albeit with the direction of each digit inverted such that each digit folds outwardly instead of inwardly. See above description of inverted assemblies 800, 1900, 2000, 2100, 2200. When each digit of assembly 2400 is in the first state (longitudinally aligned state), assembly 2400 has a stable closed tetrahedral configuration similar to that of assembly 2300. FIG. 24A illustrates assembly 2400 in an unstable closed configuration with each digit partially folded outwardly. FIG. 24B illustrates assembly 2400 in a stable closed configuration with all digits fully folded outwardly into the second state (parallel segments state).

Materials and Manufacturing

Digits according to the present disclosure may be formed using a range of materials and manufacturing techniques. In general, any material or manufacturing process may be used that enables the creation of joints that function as described in this disclosure. However, in at least one implementation, digits may be formed from thermoplastic polyurethane (TPU). In general, TPU is a flexible and durable material well-suited for consumer goods, such as toys. TPU is also amenable to a range of manufacturing processes including, but not limited to, injection molding and 3D printing.

Although TPU has properties amenable to various applications of the present disclosure, other suitable and non-limiting materials from which digits of the present disclosure include thermoplastic rubber (TPR) or polypropylene (PP). Similarly, in certain implementations digits according to this disclosure may be formed by injection molding and 3D printing; however, this disclosure contemplates other manufacturing processes including, but not limited to, molding, casting, additive manufacturing (e.g., 3D printing and variations of 3D printing, such as stereolithography (SLA), selective laser sintering (SLS), fused deposition modeling (FDM), digital light process (DLP), multi-jet fusion (MJF), direct metal laser sintering (DMLS), and electron beam melting (EBM)), and subtractive manufacturing (e.g., machining).

Hubs and components to which digits may be coupled are also not limited to any specific materials or manufacturing processes. In contrast to digits, which generally include a pliable joint, hubs and similar components may be substantially rigid and, as a result, may be formed from a broader range of materials. A non-limiting example of such a material suitable for use in forming hubs of this disclosure is acrylonitrile butadiene styrene (ABS).

Components according to this disclosure may also be formed from multiple pieces, each of which may be formed from a different metal and/or using a different manufacturing process. For example, a digit may include a TPU joint portion coupled to segments formed from a different plastic or non-plastic material.

As previously noted, in certain implementations, assemblies/structures including one or more hubs coupled to one or more digits may be manufactured such that the hubs and digits are integrally formed. In other implementations, at least a portion of the hubs and digits may be formed together as a unitary assembly that may be subsequently attached (either permanently or selectively) to one or more other digits, hubs, or assemblies of digits and hubs.

For ease of manufacturing and packaging, assemblies of digits and hubs may be formed in a substantially flat lattice or similar open structure as described above with respect to FIG. 17A using a manufacturing process (e.g., an injection molding process). The lattice may then be subsequently closed to form a closed structure by fixing certain digits and hubs.

Figure 25:
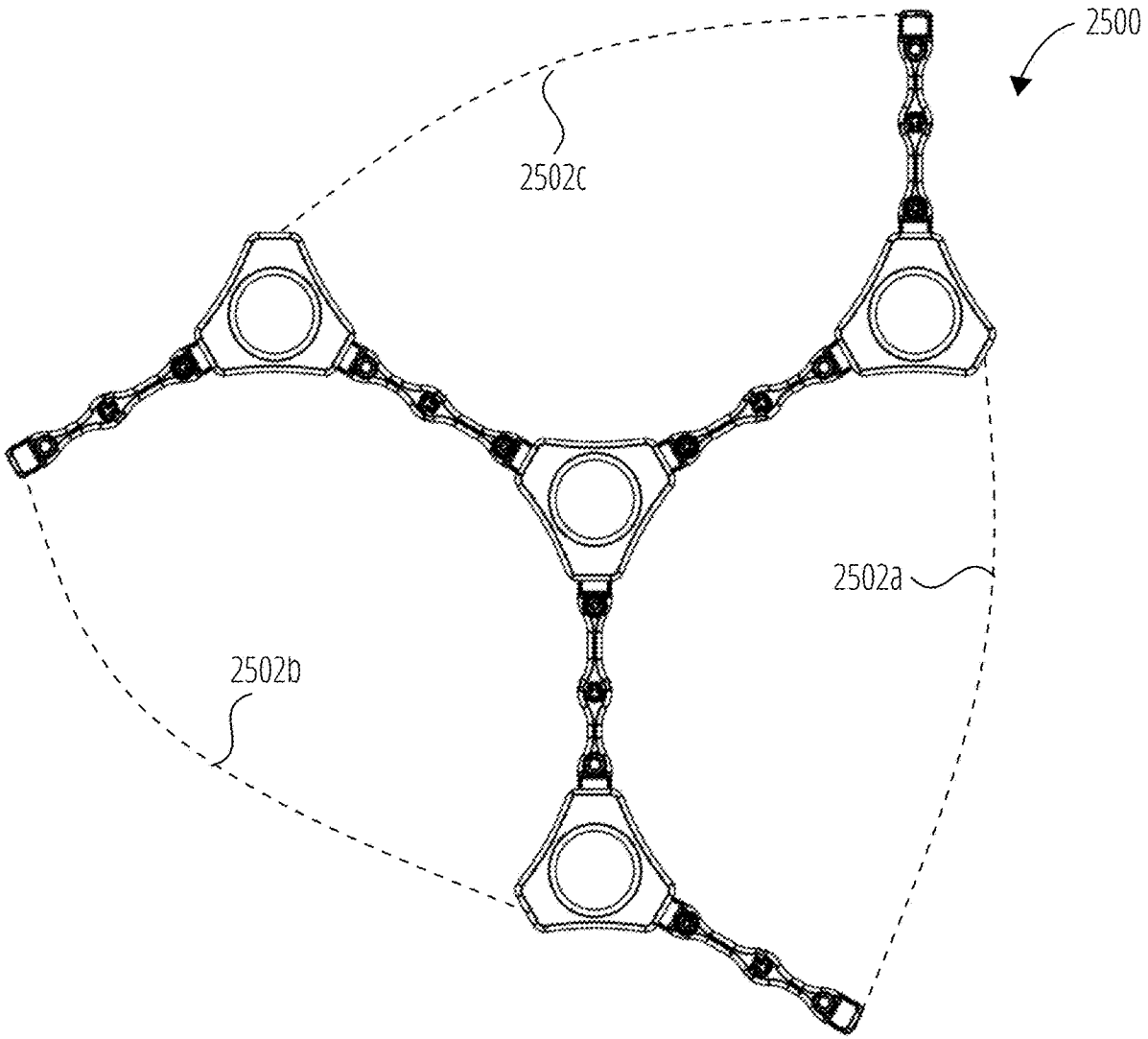
FIG. 25-FIG. 26 show lattices of hubs and digits according to an embodiment of the present disclosure.

FIG. 25, for example, illustrates a lattice 2500 of hubs and digits that may be formed using an injection molding or similar process. The lattice 2500 is substantially similar to the lattice assembly 1700 of FIG. 17A. Following formation of lattice 2500, lattice 2500 may be closed by attaching the points illustrated by attaching certain hubs and digits as indicated by lines 2502*a*-2502*c*. For example, hubs and digits may be coupled together using an adhesive, welding, or similar bonding process. When joined as illustrated by lines 2502*a*-2502*c*, lattice 2500 closes into a tetrahedral assembly, such as assembly 2300 of FIG. 23A-FIG. 23C or assembly 2400 of FIG. 24A and FIG. 24B.

Figure 26:
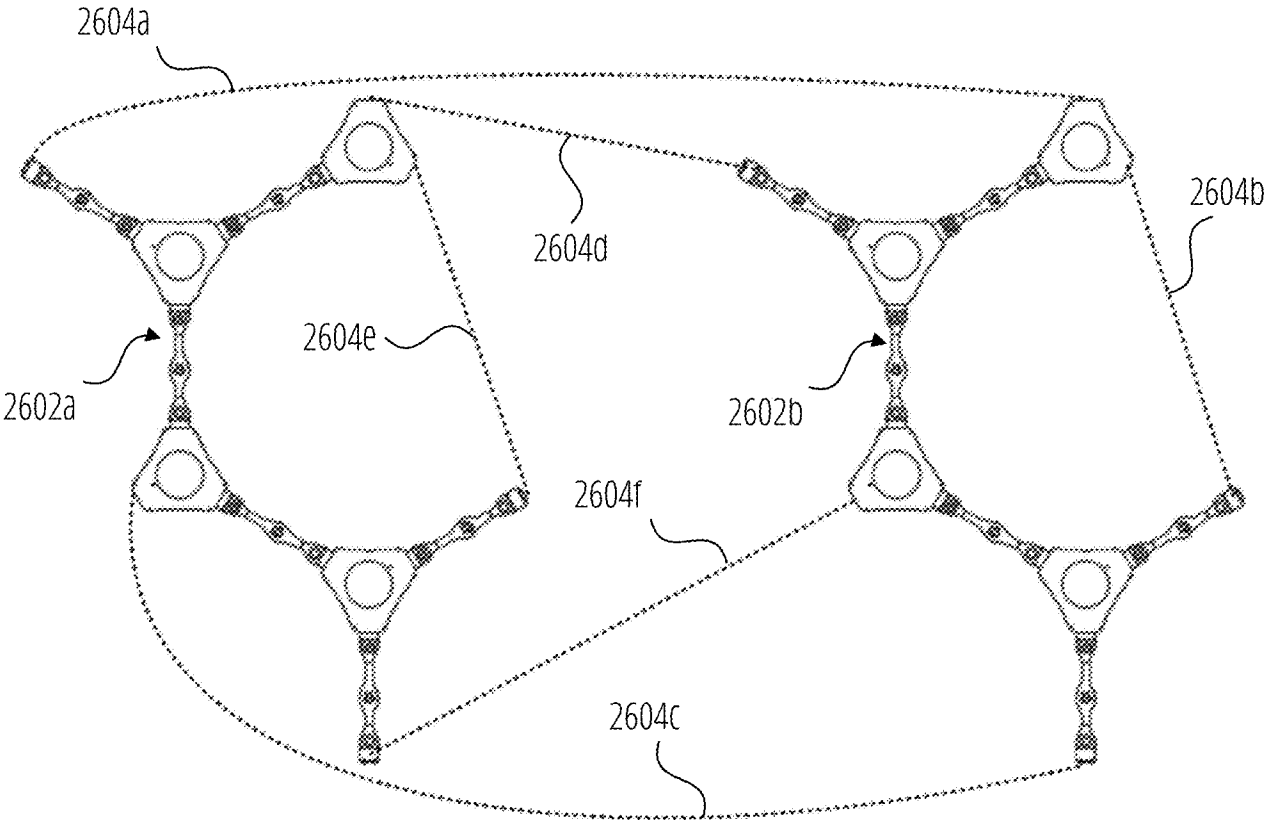

FIG. 26 illustrates a similar concept for forming a structure from multiple lattices. In particular, FIG. 26 shows a first lattice 2602*a* and a second lattice 2602*b* each formed of respective digits and hubs as described above with respect to FIG. 17A. Each of first lattice 2602*a* and second lattice 2602*b* may be separately formed, e.g., by injection molding, and subsequently coupled together into a closed structure by connecting the points indicated by guidelines 2604*a*-2604*f*. When joined as illustrated by guidelines 2604*a*-2604*f*, lattices 2602*a* and 2602*b* form a closed cubic assembly, such as assembly 1900 of FIG. 19A and assembly 2000 of FIG. 20A.

Additional Implementations

FIG. 27A-FIG. 27E illustrate an assembly 2700 according to this disclosure. Assembly 2700 is arranged in a star-shaped pattern in which five digits (e.g., digit 2702) are coupled to and extend from a central hub 2704. Each of the digits includes multiple interference joints, each of which provides tactile snapping/popping as discussed throughout this disclosure. The digits are also illustrated as fixed to central hub 2704 by a similar interference joint; however, in other implementations, the digits may alternatively be selectively couplable to central hub 2704 using any removable or permanent coupling structures discussed herein.

Figure 27B:
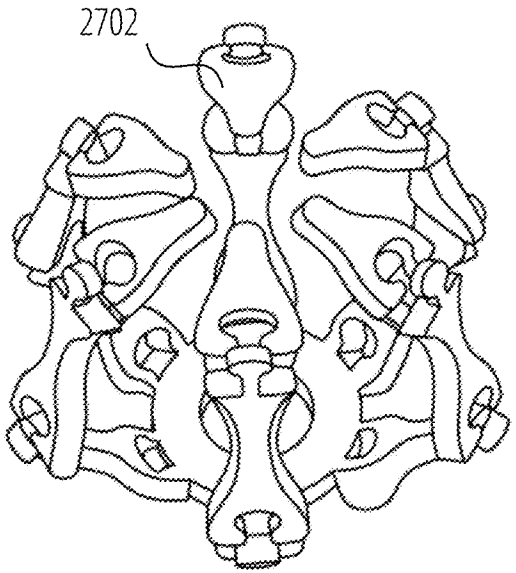
FIG. 27A-FIG. 27E show an assembly of a hub and digits in various configurations according to still another embodiment of the present disclosure.
Figure 27A:
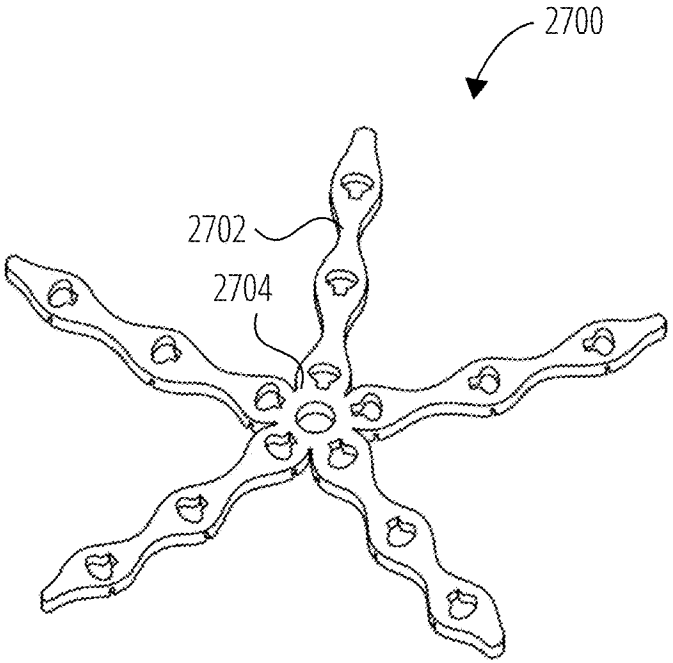
Figure 27D:
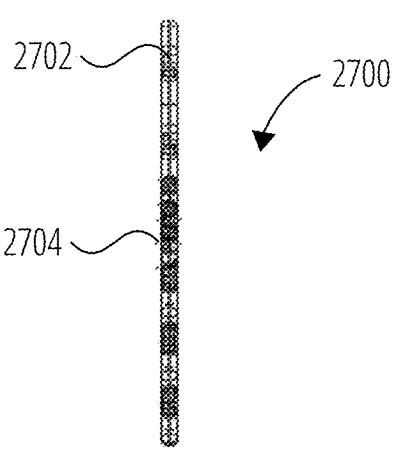

FIG. 27A illustrates assembly 2700 with each digit in a first state (longitudinally aligned state). FIG. 27B illustrates assembly 2700 with each digit in a second state.

Figure 27E:
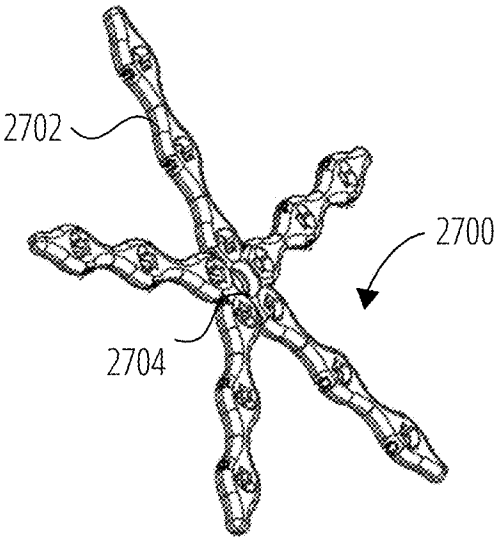
Figure 27C:
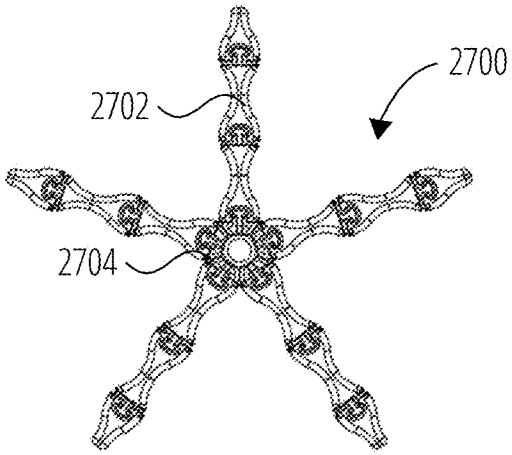
Figure 28A:
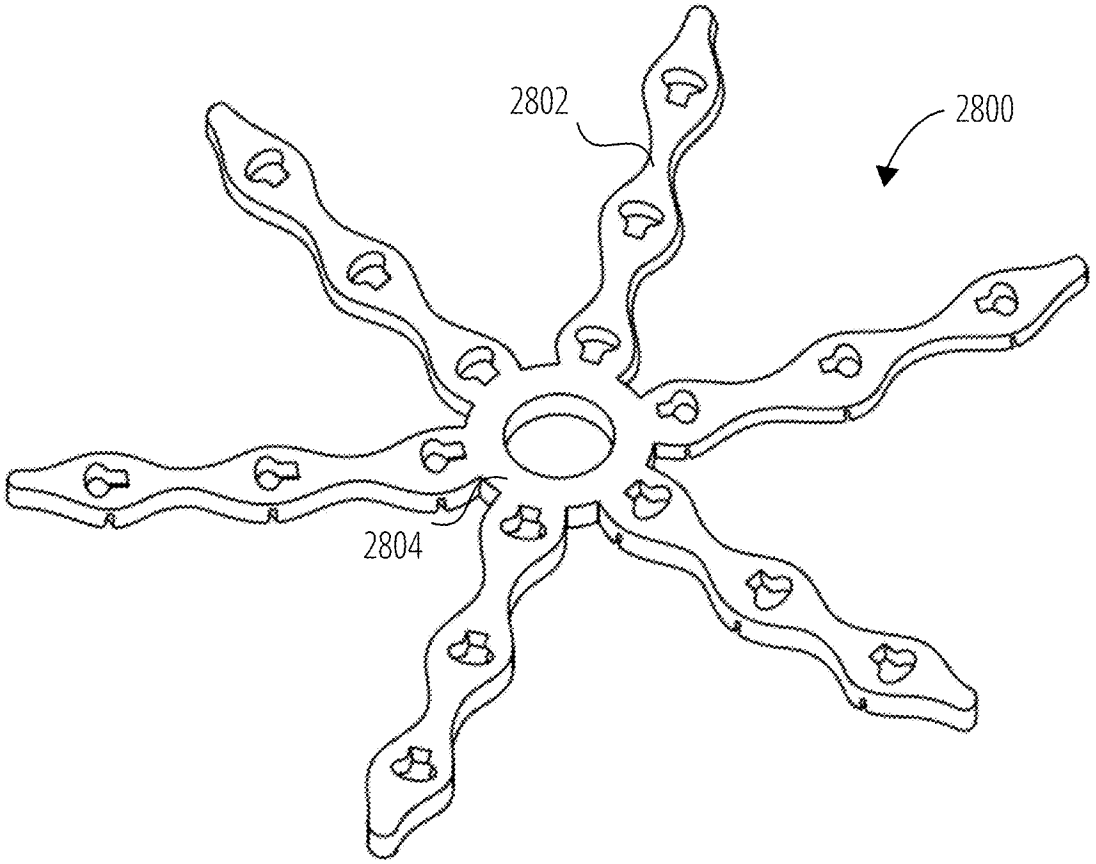
FIG. 28A-FIG. 28D show an assembly of a hub and digits in various configurations according to still another embodiment of the present disclosure.
Figure 28C:
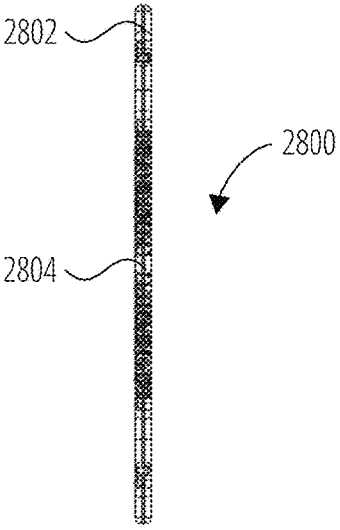
Figure 28D:
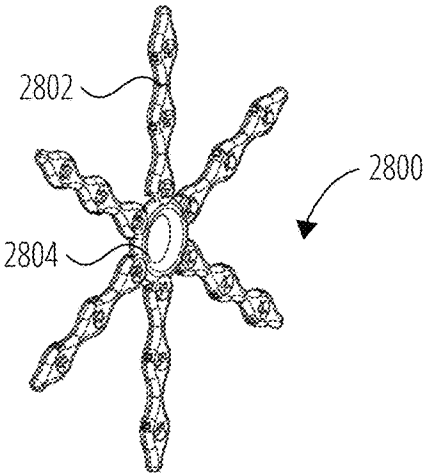
Figure 28B:
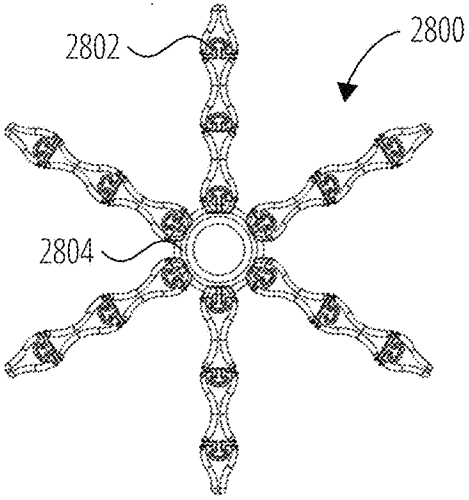

FIG. 28A-FIG. 27E illustrate an assembly 2800 that is a variation of assembly 2700. In particular, assembly 2800 includes six digits (e.g., digit 2802) extending from a central hub 2804.

FIG. 29A-FIG. 29E illustrate an assembly 2900 including a single, multi-jointed digit, each joint being an interference joint as described with respect to digit 102 of FIG. 1A. Like other digits in this disclosure, each joint in assembly 2900 can be transitioned between a first state (longitudinally aligned state) and second state with the transition providing a tactile and audible snapping/popping response.

Figure 29B:
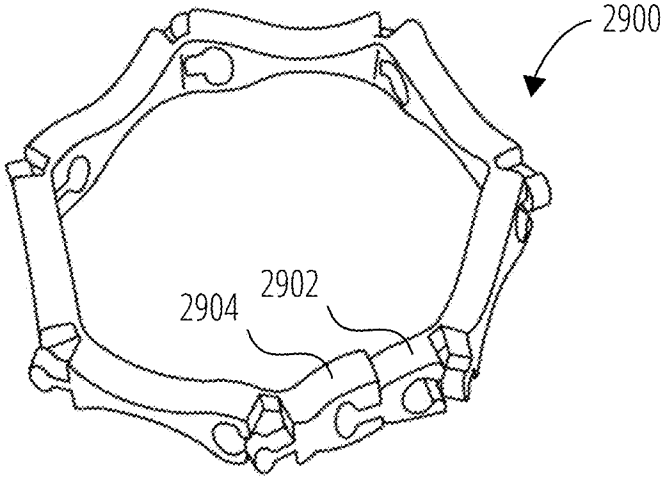
FIG. 29A-FIG. 29E show various views of a multi-jointed digit according to an embodiment of the present disclosure.
Figure 29A:
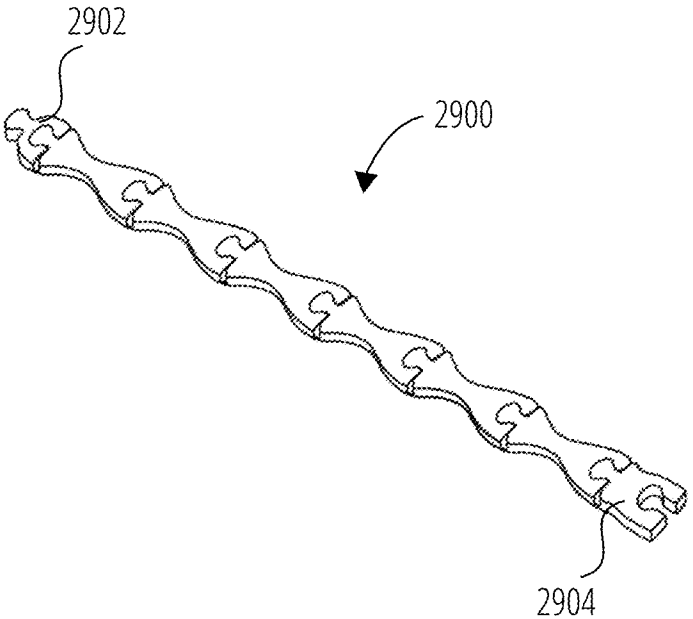
Figure 29C:
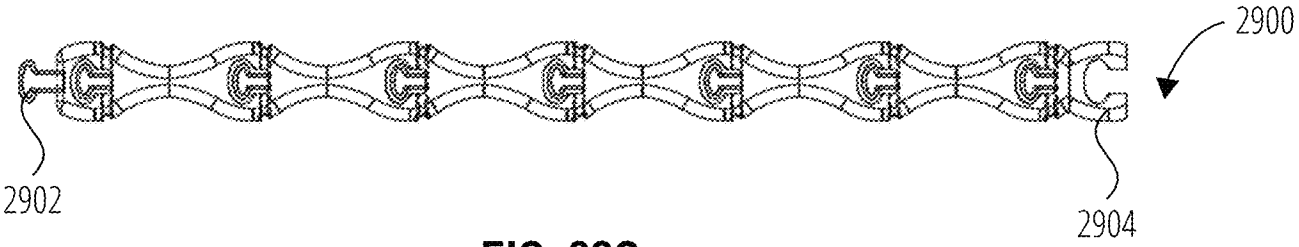
Figure 29D:
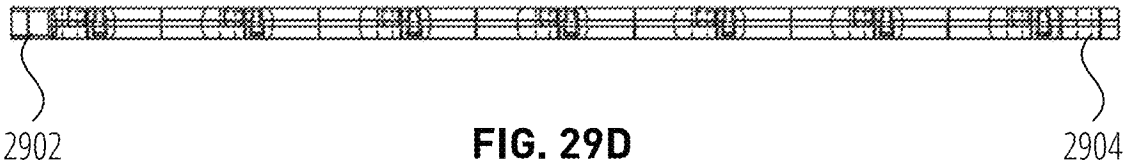
Figure 29E:
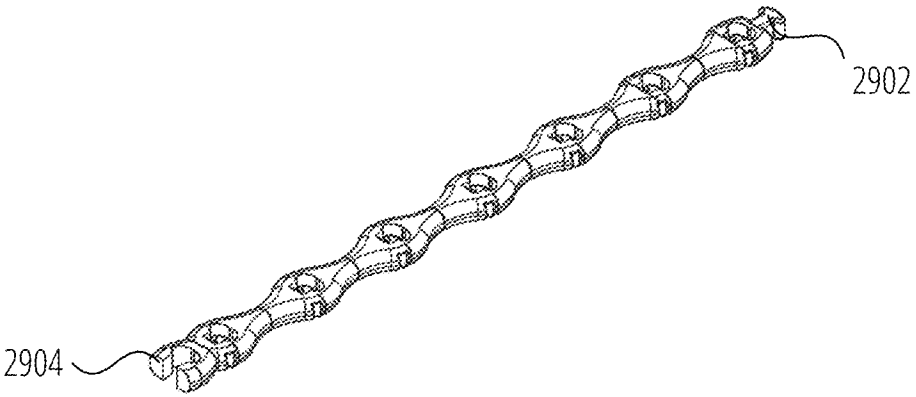

FIG. 29A illustrates assembly 2900 with each joint in the first state while FIG. 29B illustrates assembly 2900 with each joint in the second state. Assembly 2900 also includes complementary mating ends 2902, 2904 that can be coupled together to transition assembly 2900 from a linear/open structure (e.g., as shown in FIG. 29A) to a closed loop (e.g., as shown in FIG. 29B).

Figure 30B:
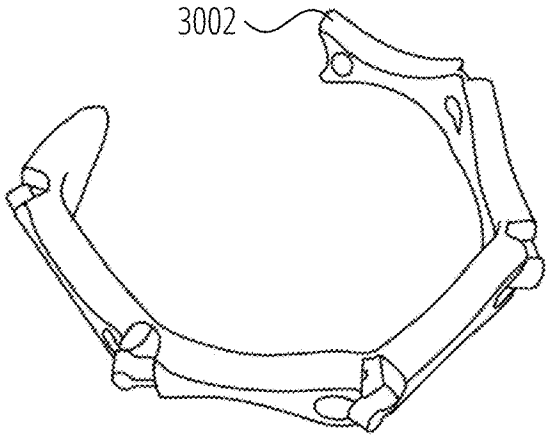
FIG. 30A-FIG. 30E show various views of a multi-jointed digit according to still another embodiment of the present disclosure.
Figure 30A:
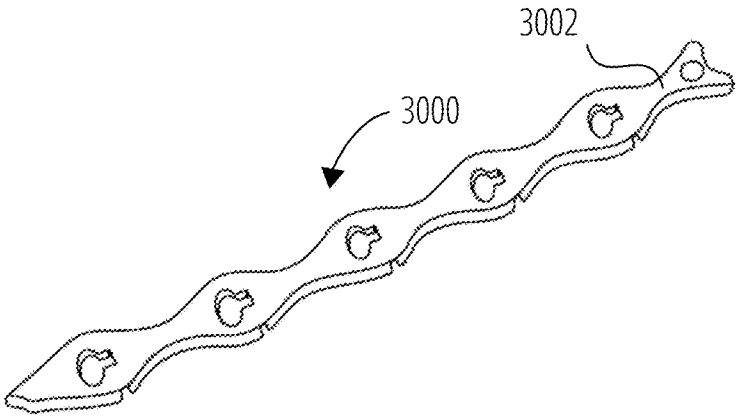
Figure 30C:
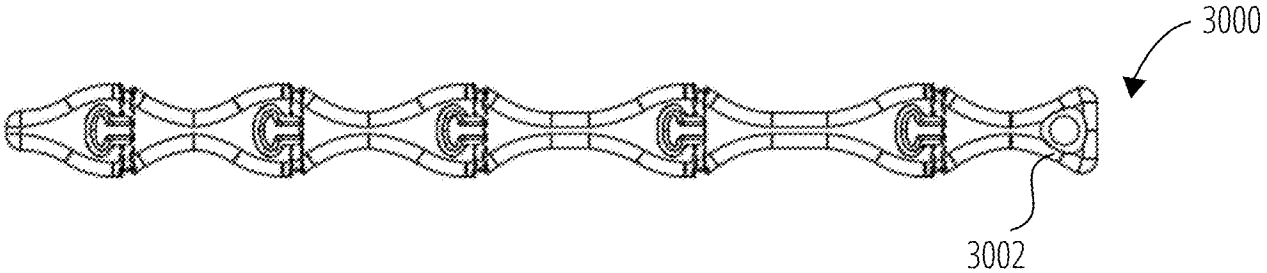
Figure 30D:
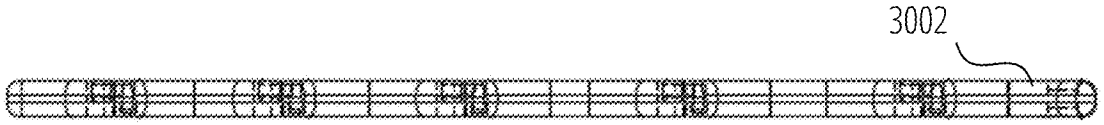
Figure 30E:
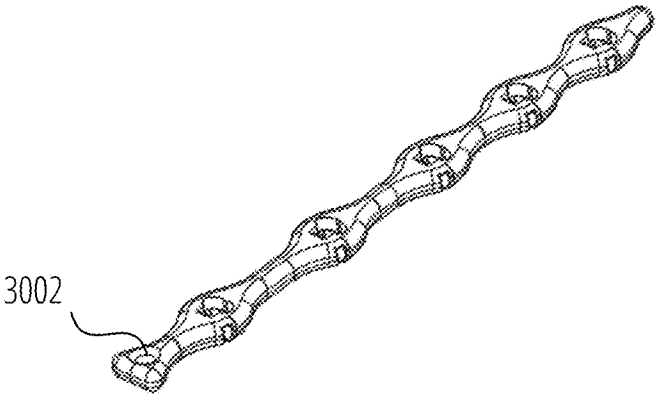

FIG. 30A-FIG. 30E illustrate another assembly 3000 including a single, multi-jointed digit. Like other digits in this disclosure, each joint in assembly 3000 can be transitioned between a first and second state with the transition providing a tactile snapping/popping response. FIG. 30A illustrates assembly 3000 with each joint in the first state while FIG. 30B illustrates assembly 3000 with each joint in the second state. As illustrated in the figures, assembly 3000 includes an end 3002 defining a coupling feature formed a hole configured to receive a projection of complementary shape.

Figure 31:
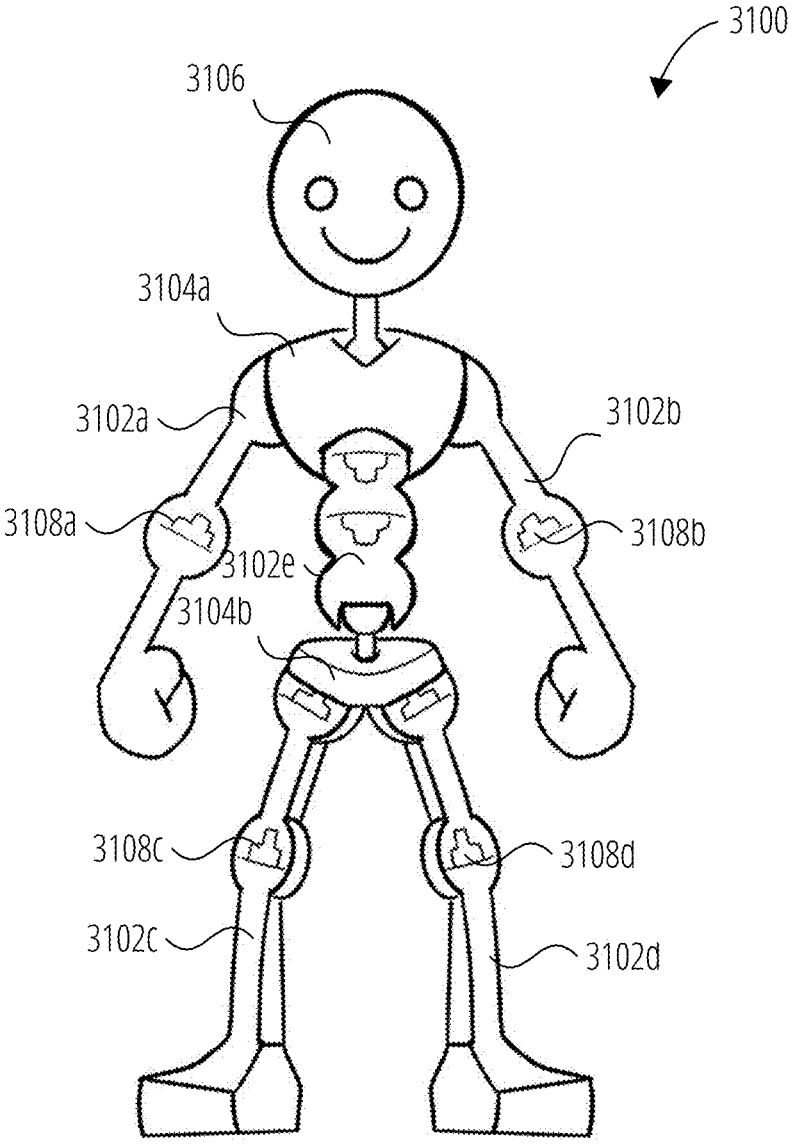
FIG. 31 shows an assembly of hubs and digits according to still another embodiment of the present disclosure.

FIG. 31 illustrates still another assembly 3100 of the present disclosure, which illustrates that digits, building elements, and assemblies of the present disclosure are not limited to purely geometric implementations. For example, the assembly 3100 resembles an anthropomorphic figure comprising a plurality of anatomical digits and hubs, similar to other assemblies previously described herein. In particular, assembly 3100 includes digits 3102*a*-3102*d*, which are operably coupled to hubs 3104*a*-3104*b* by coupling features as described above.

Digits 3102*a*, 3102*b* resemble arms and are coupled to a multi-planar hub 3104*a* resembling shoulders. Accordingly, the coupling elements of the digits 3102*a*-3102*b* and hub 3104*a* may be ball and socket type structures to simulate a humanistic range of motion. Joint 3108*a*, 3108*b* are interference joints as described above and positioned as elbows. An optional attachment 3106 resembling a head is couplable to the hub 3104*a*. Other embodiments may include additional attachments, for example, a tail.

Hub 3104*a* is coupled with hub 3104*b* by a multi-joint digit 3102*e* resembling a spine. Digit 3102*e* includes at least two interference joints as described above and includes a socket-type coupling feature at a lower end for coupling with a ball-type coupling feature of the hub 3104*b*.

Hub 3104*b* is a multi-planar hub resembling a pelvis and having coupling features for coupling to the digits 3102*c*-digit 3102*d*. As shown, the coupling features are disposed in different planes.

Digit 3102*c*, 3102*d* resemble legs, wherein joints 3108*c*, 3108*d* are positioned as knees. Advantageously, the interference joints 3108*a*-3108*d* enable the assembly 3100 to be positioned in different stances, poses, or positions.

The foregoing assembly 3100 is merely representative of one potential assembly formed by building elements of the present disclosure. It is apparent that assemblies may, in other embodiments, resemble vehicles, buildings, or other structures.

The foregoing description introduces numerous representative digits, hubs, assemblies thereof, lattices, and building sets which demonstrate the breadth of the inventions. The present disclosure includes additional digits having any combination of different types of interference joints, coupling features, and retention features described herein. The present disclosure also includes additional hubs having any number of vertexes and any combination of coupling feature types and retention feature types. Restated, different types of coupling features and retention features can be freely combined.

This disclosure does not limit aesthetic elements of digits, hubs, and other components. Digits, hubs, and other components may have any suitable ornamental design. For example, hubs and digits may be any color (including multiple colors) and/or may be printed on or otherwise adorned with graphics and similar elements (e.g., text, logos, etc.). Similarly, this disclosure does not limit tactile or similar aspects of digits and other components. For example, digits and other components according to this disclosure may include one or more surfaces that are textured, embossed, relieved, and the like.

As used herein, unless defined otherwise, all technical and scientific terms generally have the same meaning as commonly understood by one of ordinary skill in the art to which this disclosure belongs. Generally, the nomenclature used herein is those well-known and commonly employed in the art.

As used herein, the articles "a" and "an" refer to one or to more than one (i.e., to at least one) of the grammatical object of the article. By way of example, "an element" means one element or more than one element.

The expression, "at least one of A, B, or C" includes all of the following: A, B, C, AB, AC, BC, ABC.

As used herein, the term "about" will be understood by persons of ordinary skill in the art and will vary to some extent on the context in which it is used. As used herein, "about" when referring to a measurable value such as an amount, a temporal duration, and the like, is meant to encompass variations of ±20% or ±10%, more preferably ±5%, even more preferably ±1%, and still more preferably ±0.1% from the specified value, as such variations are appropriate to perform the disclosed methods.

Throughout this disclosure, various aspects of the present disclosure may be presented in a range format. It should be understood that the description in range format is merely for convenience and brevity and should not be construed as an inflexible limitation on the scope of the present disclosure. Accordingly, the description of a range should be considered to have specifically disclosed all the possible sub-ranges as well as individual numerical values within that range and, when appropriate, partial integers of the numerical values within ranges. For example, description of a range such as from 1 to 6 should be considered to have specifically disclosed sub-ranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, and 6. This applies regardless of the breadth of the range.

Although the description herein contains many example implementations, these should not be construed as limiting the scope of the current disclosure but as merely providing illustrative examples.

All references throughout this disclosure (for example, patent documents including issued or granted patents or equivalents; patent application publications; and non-patent literature documents or other source material) are hereby incorporated by reference herein in their entireties, as though individually incorporated by reference, to the extent each reference is at least partially not inconsistent with the disclosure in this application (for example, a reference that is partially inconsistent is incorporated by reference except for the partially inconsistent portion of the reference).

Those skilled in the art will recognize or be able to ascertain using no more than routine experimentation, numerous equivalents to the specific procedures, embodiments, claims, and examples described herein. Such equivalents were considered to be within the scope of this disclosure and covered by the claims appended hereto. In general, the terms and phrases used herein have their art-recognized meaning, which can be found by reference to standard texts, journal references, and contexts known to those skilled in the art. Any preceding definitions are provided to clarify their specific use in the context of the present disclosure.

It is to be understood that wherever values and ranges are provided herein, all values and ranges encompassed by these values and ranges, are meant to be encompassed within the scope of the present disclosure. Moreover, all values that fall within these ranges, as well as the upper or lower limits of a range of values, are also contemplated by the present disclosure.

The disclosures of each and every patent, patent application, and publication cited herein are hereby incorporated herein by reference in their entirety.

While this disclosure includes reference to specific embodiments, it is apparent that other embodiments and variations of this disclosure may be devised by others skilled in the art without departing from the true spirit and scope of the disclosure. The appended claims are intended to be construed to include all such embodiments and equivalent variations.

What is claimed is:

1. A toy, comprising:

at least one digit, wherein the at least one digit comprises a first segment and a second segment connected by a joint, wherein the joint comprises interference members and a hinge connecting ends of the first segment and the second segment, wherein the interference members of the joint interfere as the first segment and the second segment transition between a first state and a second state, wherein the first segment and the second segment each comprise a first retention feature disposed on a same first side thereof distal from the joint, wherein the first retention features reversibly retain the first segment to the second segment in the second state, wherein the interference members are configured to interfere with each other when the first segment and the second segment are in the first state and through an interference range of motion and to release from interference with each other outside the interference range of motion, and wherein the hinge permits rotation of the first segment and the second segment about the joint between the first state and the second state through the interference range of motion.

2. The toy of claim 1, wherein the interference members comprise interlocking ends of the first segment and the second segment, wherein the interlocking ends are configured to resist rotation of the first segment and the second segment about the joint in the first state and through the interference range of motion, and wherein the interlocking ends are configured to release from engagement with each other outside the interference range of motion to permit rotation of the first segment and the second segment about the joint into the second state with minimal resistance.

3. The toy of claim 2, wherein the interlocking ends comprise a socket and a protrusion.

4. The toy of claim 1, wherein in the first state, the first segment and the second segment are longitudinally aligned, and wherein in the second state, the first segment and the second segment are substantially parallel.

5. The toy of claim 4, wherein the first segment and the second segment are configurable to an intermediate state, and wherein in the intermediate state, the first segment and the second segment are out of longitudinal alignment and the first retention features are uncoupled.

6. The toy of claim 1, wherein the hinge is offset from a midplane of at least one of the first segment or second segment.

7. The toy of claim 1, wherein the interference members comprise a plurality of links, each link extending from an end of the first segment or the second segment.

8. The toy of claim 7, wherein the first segment and the second segment each comprise a second retention feature disposed on a same second side thereof, wherein the second retention features are configured to reversibly retain the first segment to the second segment.

9. The toy of claim 1, wherein the first segment and the second segment each comprise a coupling feature formed as a projection or a recess at a distal end thereof.

10. The toy of claim 1, wherein the interference members are configured to produce an audible and/or tactile pop feedback response when the first segment and the second segment enter or leave the first state.

11. The toy of claim 1, wherein the retention features are configured to produce an audible and/or tactile pop feedback response when the first segment and the second segment enter or leave the second state.

12. The toy of claim 1, wherein the at least one digit comprises a plurality of digits connected end to end in a loop.

13. The toy of claim 12, wherein the plurality of digits in the loop are configured to be connected to each other by the respective retention features.

14. The toy of claim 1, further comprising a plurality of hubs, wherein the at least one digit comprises a plurality of digits, wherein each digit is coupled to two of the plurality of hubs at distal ends of the digit to form an assembly, and wherein the assembly is configurable between a plurality of stable configurations and a plurality of unstable configurations.

15. The toy of claim 14, wherein in each of the stable configurations, each of the plurality of digits is stabilized in the first state or the second state and wherein in each of the unstable configurations, at least one digit of the plurality of digits freely bends about the respective joint.

16. The toy of claim 14, wherein the assembly comprises two or more independent degrees of freedom.

17. The toy of claim 14, wherein the assembly is configured to be turned inside out without uncoupling the plurality of digits from the plurality of hubs.

18. The toy of claim 14, wherein the first segment and the second segment of each of the plurality of digits comprises a hub coupling feature disposed at a distal end thereof, wherein each of the plurality of hubs comprises a plurality of digit coupling features disposed around a body, and wherein the hub coupling features of each digit connect with the digit coupling features of the respective hubs.

19. The toy of claim 18, wherein the plurality of digits and the plurality of hubs form a lattice.

20. The toy of claim 18, wherein the hub coupling features and the digit coupling features comprise complementary structures.

21. A toy assembly, comprising:

a plurality of hubs connected with a plurality of digits, wherein each hub comprises a body, wherein each digit comprises:

a first segment and a second segment connected by a joint, wherein the first segment and the second segment are configured rotate about the joint with respect to each other to transition between a first state and a second state, wherein the joint is configured to retain the first segment and the second segment in the first state, and wherein the first segment and the second segment each comprise a first retention feature disposed on a same first side thereof, wherein the first retention features reversibly retain the first segment and the second segment in the second state, wherein each digit is connected to two of the plurality of hubs at opposing ends of the digit, wherein the first segment and the second segment of each of the plurality of digits comprises a hub coupling feature disposed at a distal end thereof, wherein the hub coupling features of each digit connect with the bodies of the respective hubs, and wherein the assembly is configurable between a plurality of stable configurations and a plurality of unstable configurations.

22. The toy assembly of claim 21, wherein in each of the stable configurations, each of the plurality of digits is stabilized in the first state or the second state and wherein in each of the unstable configurations, at least one digit of the plurality of digits freely bends about the respective joint.

23. The toy assembly according to claim 21, wherein the joint of each digit comprises a hinge and interference members, and wherein the interference members of the joint interfere as the joint transitions between the first state and the second state.

24. A toy assembly, comprising:

a plurality of hubs coupled with a plurality of digits, wherein each digit comprises:

a first segment and a second segment connected by a joint, wherein the first segment and the second segment are configured rotate about the joint with respect to each other to transition between a first state and a second state, wherein the joint is configured to retain the first segment and the second segment in the first state, and wherein the first segment and the second segment each comprise a first retention feature disposed on a same first side thereof, wherein the first retention features reversibly retain the first segment and the second segment in the second state, wherein each digit is coupled to two of the plurality of hubs at opposing ends of the digit, wherein the assembly is configurable between a plurality of stable configurations and a plurality of unstable configurations, wherein the first segment and the second segment of each of the plurality of digits comprises a hub coupling feature disposed at a distal end thereof, wherein each of the plurality of hubs comprises a plurality of digit coupling features disposed around a body, and wherein the hub coupling features of each digit connect with the digit coupling features of the respective hubs.

25. The toy assembly of claim 21, wherein the assembly comprises two or more independent degrees of freedom.

* * * * *